US012064029B2

(12) United States Patent
Powley

(10) Patent No.: US 12,064,029 B2
(45) Date of Patent: Aug. 20, 2024

(54) SURFACE-TOP ASSEMBLY

(71) Applicant: CoCreateX, Saint Paul, MN (US)

(72) Inventor: Nicholas R. Powley, Hudson, WI (US)

(73) Assignee: CoCreateX, Saint Paul, MN (US)

( * ) Notice: Subject to any disclaimer, the term of this patent is extended or adjusted under 35 U.S.C. 154(b) by 117 days.

(21) Appl. No.: 17/466,831

(22) Filed: Sep. 3, 2021

(65) Prior Publication Data

US 2022/0061520 A1 Mar. 3, 2022

Related U.S. Application Data

(60) Provisional application No. 63/074,467, filed on Sep. 3, 2020.

(51) Int. Cl.
*A47C 27/00* (2006.01)
*A47B 13/08* (2006.01)

(52) U.S. Cl.
CPC ..... *A47B 13/08* (2013.01); *A47B 2220/008* (2013.01)

(58) Field of Classification Search
CPC ..... A47B 13/08; A47B 2220/008
See application file for complete search history.

(56) References Cited

U.S. PATENT DOCUMENTS

| | | | | |
|---|---|---|---|---|
| 3,908,218 | A * | 9/1975 | Oishi | A47L 13/16 15/229.11 |
| 10,399,473 | B1 * | 9/2019 | Moseley | B60N 2/787 |
| 11,147,390 | B2 * | 10/2021 | Mabon | A47C 27/064 |
| 2009/0256384 | A1 * | 10/2009 | Hughes, Jr. | B60N 2/78 296/153 |
| 2013/0127217 | A1 * | 5/2013 | Goetsch | A47C 27/086 297/227 |
| 2022/0031013 | A1 * | 2/2022 | Dharia | A43B 19/00 |
| 2023/0115100 | A1 * | 4/2023 | Lim | A47C 27/15 5/636 |

* cited by examiner

*Primary Examiner* — Amy J. Sterling
(74) *Attorney, Agent, or Firm* — Husch Blackwell LLC

(57) ABSTRACT

A surface-top in accordance with the present disclosure includes a surface and a padding disposed vertically higher than the surface.

3 Claims, 42 Drawing Sheets

SURFACE-TOP ASSEMBLY

RELATED APPLICATION

The present application claims the benefit of U.S. Provisional Application No. 63/074,467 entitled "A SURFACE-TOP ASSEMBLY", filed Sep. 3, 2021, which is incorporated herein by reference in its entirety.

TECHNICAL FIELD

The present disclosure relates to a surface-top assembly, and, more specifically, to a cushioned device placed on top of the surface-top assembly to soften an impact created when a body part is to be placed on top of the surface-top assembly.

BACKGROUND

Carpal Tunnel Syndrome" occurs as a result of repetitive flexion of the wrist joints. The syndrome causes extreme pain most often to a person's wrist. There is a need for a product that reduces the impact and pressure on the wrists of a user.

SUMMARY

A surface-top in accordance with the present disclosure includes a surface and a padding disposed vertically higher than the surface.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which.

Figure 1:
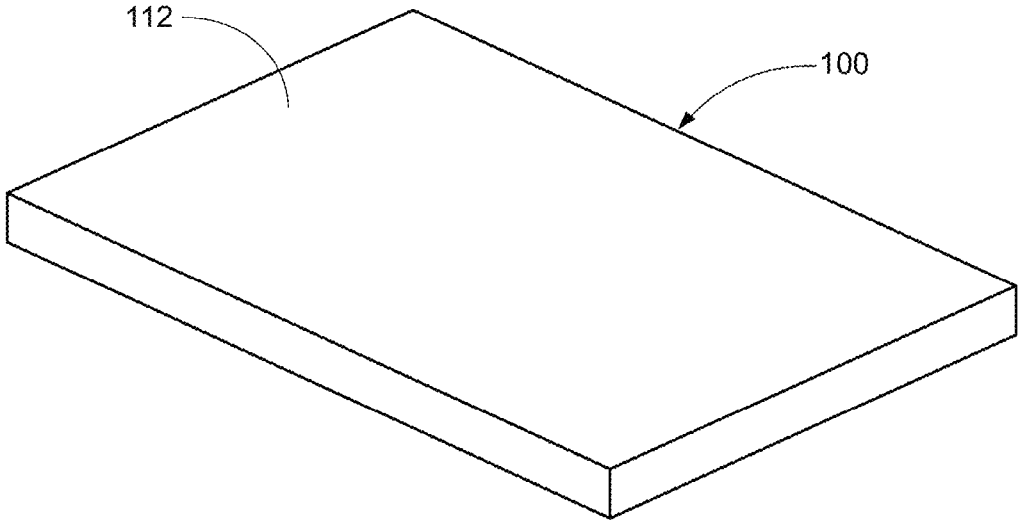
FIG. 1 is a perspective view of a cushioned device according to one embodiment of the present disclosure.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

The present disclosure is directed to a surface-top assembly 100 as shown in FIG. 1. In one exemplary embodiment, the surface-top assembly 100 may alleviate a plurality of conditions and/or symptoms associated with Carpal Tunnel Syndrome and related diagnoses, which oftentimes lead to a surgical operation or a related procedure to lessen pain. In another exemplary embodiment, the table-top assembly 100 may prevent the emergence of those painful conditions and/or symptoms altogether, thereby minimizing the probability of a person having to undergo the surgical operation or the related procedure.

Various example embodiments will be described more fully hereinafter with reference to the accompanying drawings, in which some example embodiments are shown. The inventive concepts revealed in the present disclosure may, however, be embodied in many different forms and should not be construed as limited to the exemplary embodiments set forth herein.

It should be understood that when an element or a layer is referred to as being "on," "connected to," or "coupled to" another element or layer, it can be directly on, connected, or coupled to the other element or layer or intervening elements or layers that may be present. In contrast, when an element or a layer is referred to as being "directly," "directly connected to," or "directly coupled to" another element or layer, there are no intervening elements or layers present.

Like numerals refer to like elements throughout. As used herein, the term "and/or" includes any and all combinations of one or more of associated listed items.

Spatially-relative terms, such as "beneath," "below," "lower," "above," "upper," and the like, may be used herein for ease of description to describe a relationship of one element or feature to another element(s) or feature(s) as illustrated in the figures.

Terminology used herein is for a purpose of describing particular exemplary embodiments only and is not intended to be limiting of the present inventive concepts. As used herein, singular forms "a," "an," and "the" may be intended to include the plural forms as well, unless context clearly indicates otherwise. It should be further understood that the terms "comprises" and/or "comprising," when used in this specification, specify presence of stated features, integers, steps, operations, elements, and/or components, but do not preclude presence or addition of one or more other features, integers, steps, operations, elements, components, and/or groups thereof.

Exemplary embodiments are described herein with reference to cross-sectional illustrations that are schematic illustrations of idealized example embodiments (and intermediate structures). As such, variations from shapes of the illustrations as a result, for example, of manufacturing techniques and/or tolerances, are to be expected. Thus, exemplary embodiments should not be construed as limited to the particular shapes of regions illustrated herein but are to include deviations in shapes that result, for example, from manufacturing.

Although corresponding plan views and/or perspective views of some cross-sectional view(s) may not be shown, the cross-sectional view(s) of assembly structures illustrated herein provide support for a plurality of device structures that extend along two different directions as would be illustrated in a plan view, and/or in three different directions as would be illustrated in a perspective view. The two different directions may or may not be orthogonal to each other. The three different directions may include a third direction that may be orthogonal to the two different directions. The plurality of device structures may be integrated in a same device. The plurality of assembly and device structures may be arranged in an array and/or in a two-dimensional pattern.

FIG. 1 shows an exemplary embodiment of a cushioned device 112. The cushioned device may comprise foam or a material with similar qualities and characteristics. In one exemplary embodiment, the cushioned device may be inflatable, where the inflatable cushioned device may further comprise any or all of a singular chamber or a plurality of segmented or reinforced chambers.

In one exemplary embodiment, the cushioned device may comprise a plurality of cushions coupled to one another in order to form the whole cushioned device. The plurality of cushions may, for example, be coupled to one another using VELCRO® or another suitable fastener. Using the plurality of cushions would allow the cushioned device to be folded in half.

Figure 2:
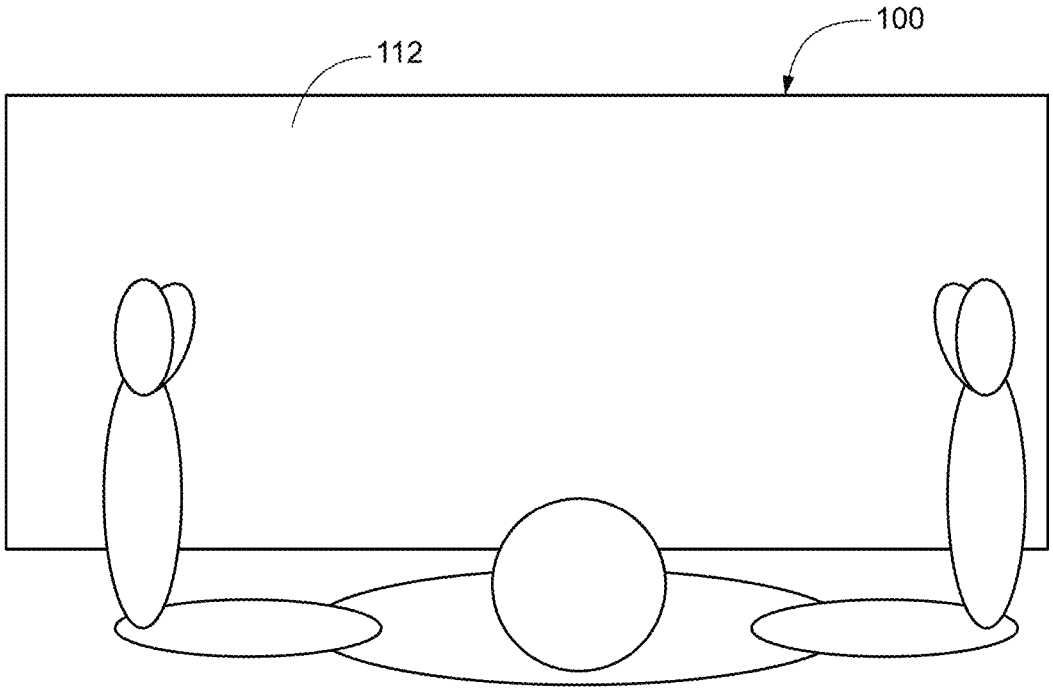
FIG. 2 is a top view of a cushioned device according to one embodiment of the present disclosure.
Figure 3:
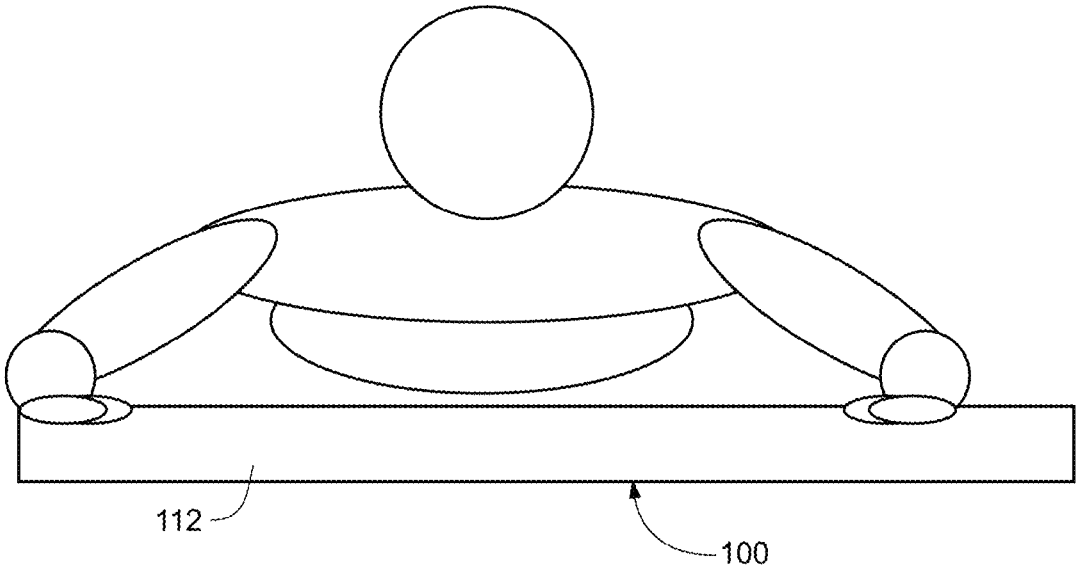
FIG. 3 is a back view of a cushioned device according to one embodiment of the present disclosure.

As illustrated in the exemplary embodiment shown in FIGS. 2 and 3, the surface-top assembly 100 is movable (or, non-stationary).

In the embodiment illustrated in FIGS. 2 and 3, the article of furniture 104 having the broad, usually level, writing surface 112 is a movable, non-stationary lap desk.

As shown in the exemplary embodiments depicted in FIGS. 2 to 3, the cushioned device 112 is sized according to a length of a forearm and a hand of a user. In another embodiment, the cushioned device 112 extends longitudinally as long as a first distance measured between a left forearm and a right forearm of the user. The distance can be measured and adjusted by the user as the user sets up the cushioned device 112. In another embodiment, the cushioned device 112 extends longitudinally a second distance longer than the distance measured between the left forearm and the right forearm of the user on a left end and a right end of the cushioned device 112, respectively. In one exemplary embodiment, the second distance can be a half inch on both the left end and the right end of the cushioned device 112. This exemplary embodiment would provide the user the ability to adjust a horizontal length of the cushioned device 112 so as to suit physical dimensions of the user.

Figure 4A:
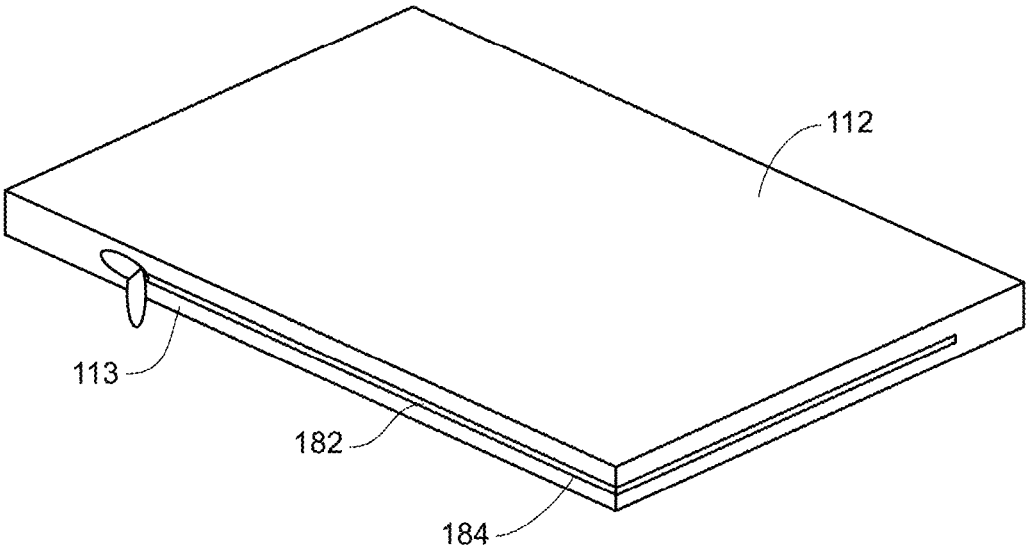
FIG. 4A is a perspective view of a cushioned device according to one embodiment of the present disclosure.
Figure 4B:
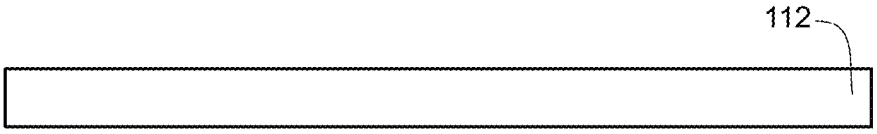
FIG. 4B is a back view of a cushioned device according to one embodiment of the present disclosure.
Figure 4C:
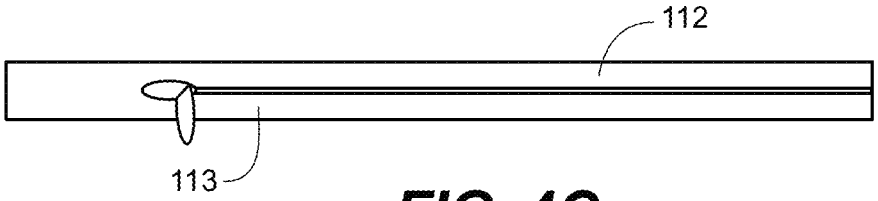
FIG. 4C is a front view of a cushioned device according to one embodiment of the present disclosure.

In a further embodiment as shown in FIG. 4, the cover comprises a zipper mechanism 113. Alternatively, a hook and loop reclosable fastener, a button and button hole, or other closure mechanisms, such as a folded or folding mechanism may be used. A heat seal or an adhesive are examples of a non-reclosable mechanism that could be used to seal the cover. The zipper mechanism has a zipper pattern embedded within the cover. The zipper mechanism may be disposed within a single edge of the cushioned device 112. In another embodiment, there may be a plurality of, but at least one, zipper mechanisms disposed within more than one edge of the cushioned device 112. In one embodiment, the plurality of zipper mechanisms are continuous (that is, connected to one another in a continuous manner). In a different embodiment, the plurality of zipper mechanisms are not connected to each other, yet each of the plurality of zipper mechanisms are disposed within each of the edges of the cushioned device 112, respectively. Other embodiments may include more than one closure mechanism working in concert with other closure mechanisms. For example, a button and a button hole may be used to supplement a zipper, where the zipper is backdrivable.

Figure 5:
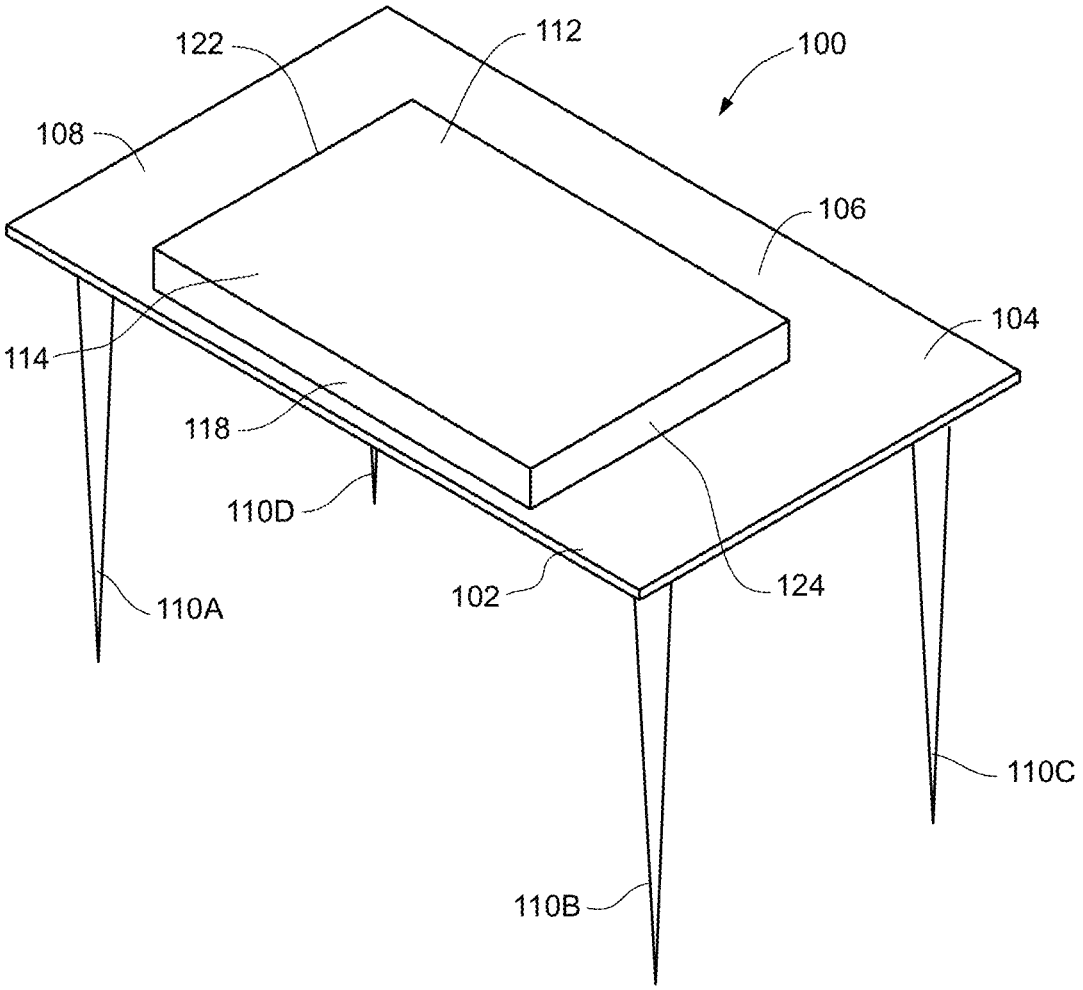
FIG. 5 is a perspective view of a surface-top assembly according to an embodiment of the present disclosure.

FIG. 5 is a perspective view illustrating the surface-top assembly 100 according to an exemplary embodiment of the present disclosure. The surface-top assembly 100 may prevent altogether, or alleviate, symptoms and/or conditions associated with Carpal Tunnel Syndrome and similar median nerve-compression conditions causing numbness, tingling, or weakness in a body part, such as, for example, an arm or a hand. The surface-top assembly 100 may be stationary or movable.

As illustrated in the exemplary embodiment shown in FIG. 5, the surface-top assembly 100 is stationary in that the surface-top assembly 100 has a fixed position relative to a continuous, lower supporting surface 102 extending horizontally throughout a part of a building, such as, for example, a floor of a room, a hallway, or the like, upon which a user may walk. In one embodiment, the surface-top assembly 100 comprises an article of furniture 104. In one embodiment, the article of furniture 104 is a stationary table 106. The stationary table 106 has a flat, slab-like top 108 supported by one or a plurality of legs 110 or other similar-type supports. Specifically, in the exemplary embodiment shown in FIG. 5, the stationary table 110 has four legs 110A, 110B, 1120, and 110D. However, in other embodiments, the stationary table 108 can be supported by one leg 110.

In an exemplary embodiment illustrated in FIG. 5, the article of furniture 102 is a stationary desk 106. The stationary desk 106 may include a writing surface 108 that is broad and usually level. It should be noted, however, that, in one embodiment, the writing surface 108 may be referred to as a reading surface without departing from the scope of the present disclosure. The writing surface 108 is supported by the one or more legs 110 or other similar-type of supports. The cushioned device 112 is placed on the stationary desk 106.

Figure 6:
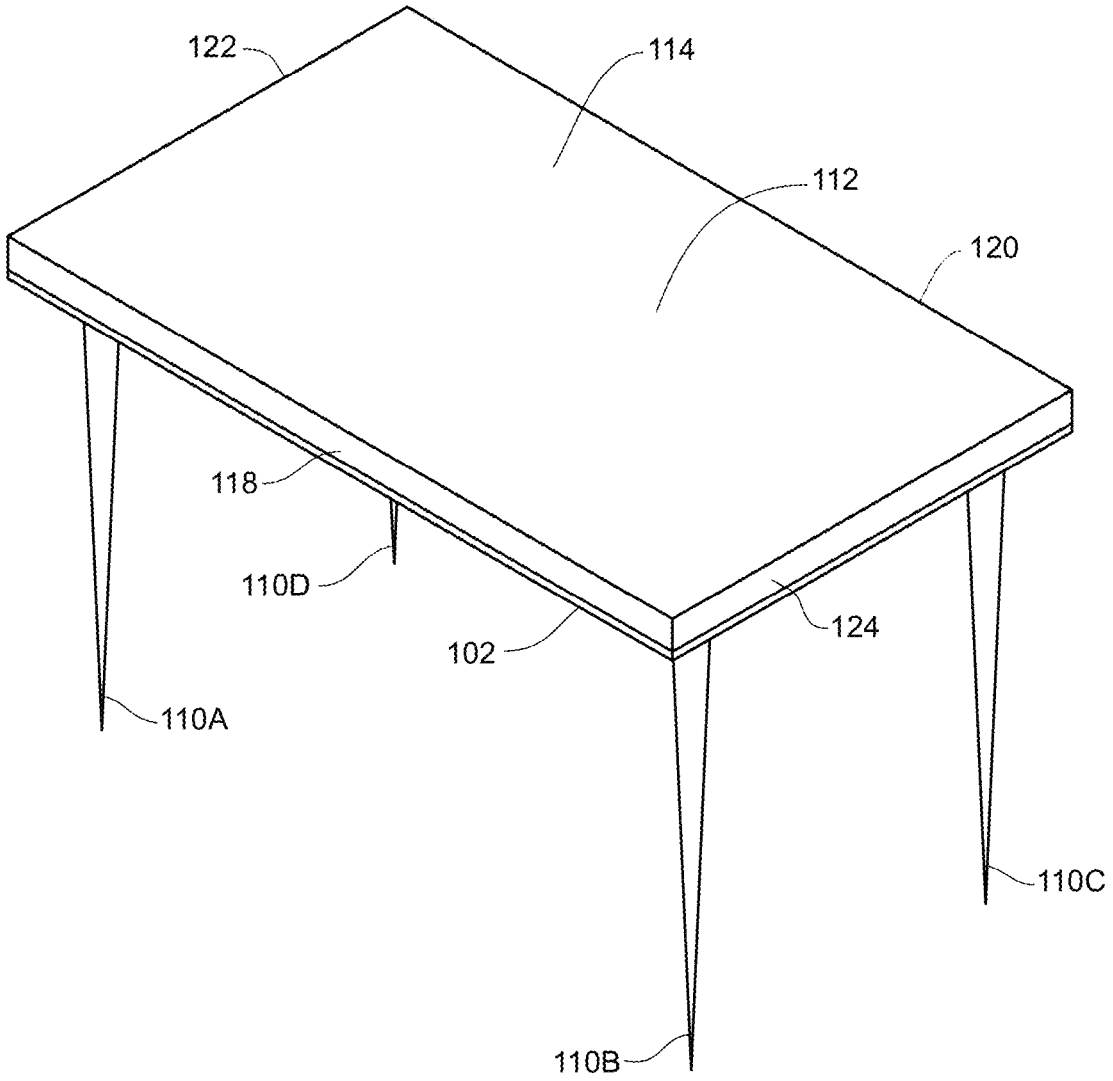
FIG. 6 is a perspective view of a surface-top assembly according to one embodiment of the present disclosure.

As shown in FIGS. 5 and 6, the stationary table 106 is coupled to a cushioned device 112. An exemplary embodiment of the cushioned device 112 is depicted in FIGS. 2-4. As shown in those figures, the cushioned device 112 comprises a first panel 114 and a second panel 116, where the first panel 114 is disposed vertically above the second panel 116. The first panel 114 comprises a front first panel border 118, a back first panel border 120, a left first panel side border 122, and a right first panel side border 124. The front first panel border 118 is disposed closest to the user. The front first panel border 118 extends longitudinally and in a plane parallel relative to the back first panel border 120. The back first panel border 120 is further away from the user than the front first panel border 118.

Figure 7A:
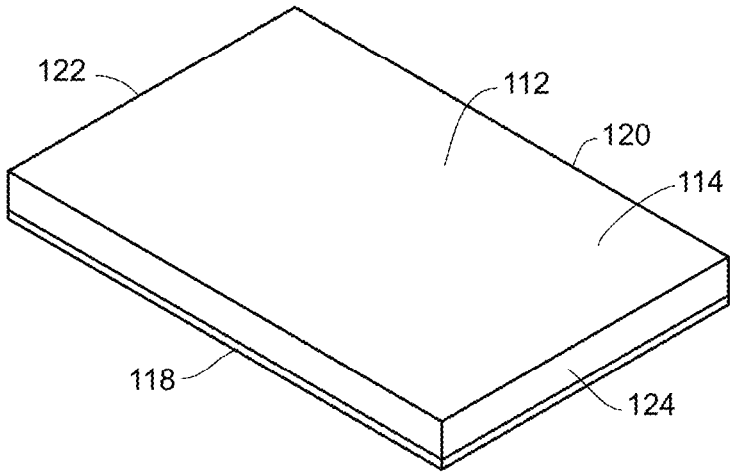
FIG. 7A is a perspective view of a cushioned device according to one embodiment of the present disclosure.
Figure 7B:
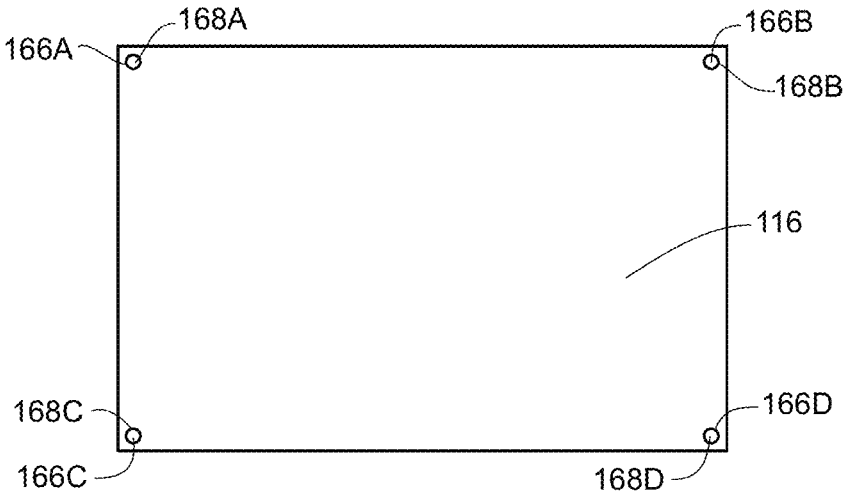
FIG. 7B is a bottom view of a cushioned device according to one embodiment of the present disclosure.
Figure 7C:
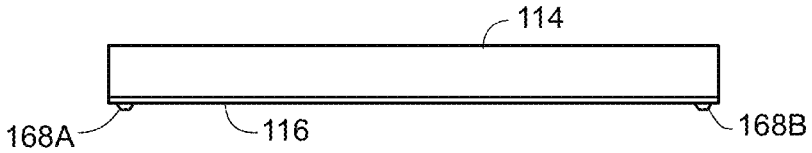
FIG. 7C is a front view of a cushioned device according to one embodiment of the present disclosure.

In one exemplary embodiment shown in FIG. 7, the first panel 116 comprises a plurality of first panel openings 166A, 166B, 166C, and 166D. Each of the plurality of first panel openings 166A, 166B, 166C, and 166D receives a first magnet 168A, 168B, 168C, and 168D, respectively.

Figure 8A:
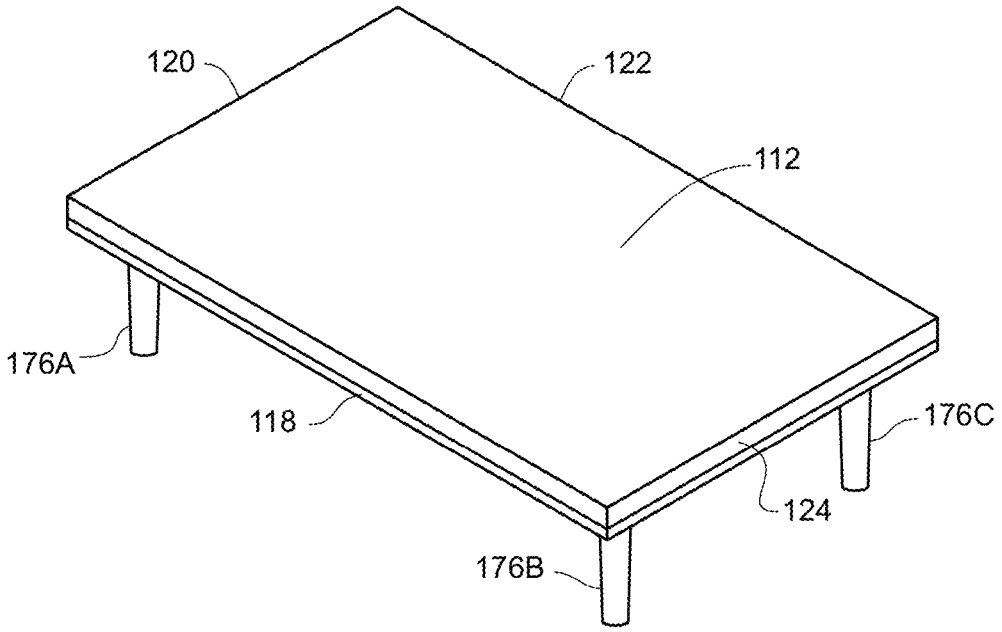
FIG. 8A is a perspective view of a cushioned device according to one embodiment of the present disclosure.
Figure 8B:
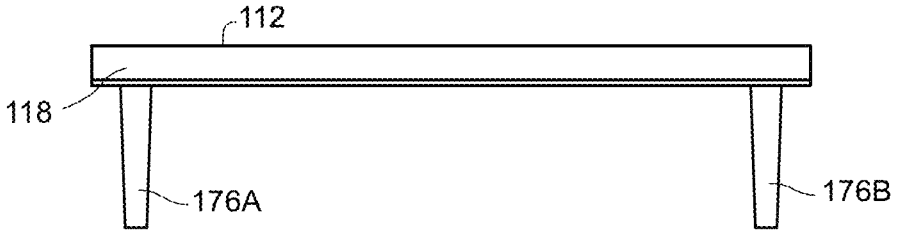
FIG. 8B is a side view of a cushioned device according to one embodiment of the present disclosure.
Figure 8C:
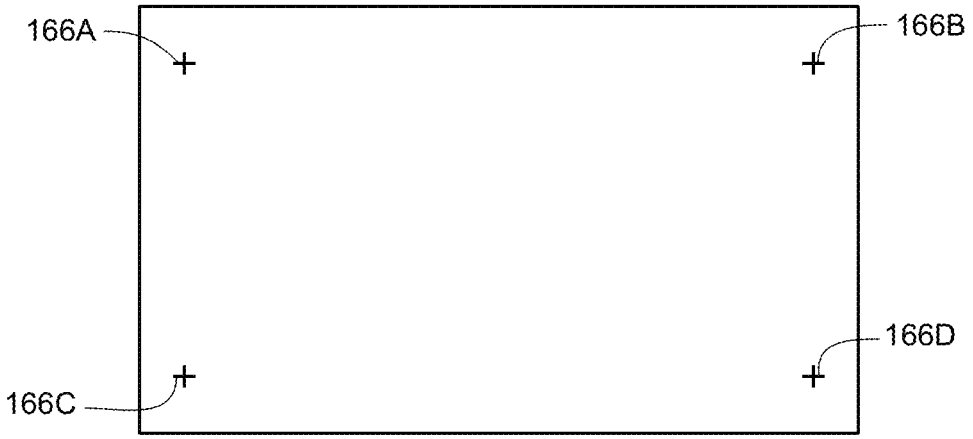
FIG. 8C is a top view of a cushioned device according to one embodiment of the present disclosure.

In another exemplary embodiment shown in FIG. 8, each of the plurality of first panel openings 166A, 166B, 166C, and 166D receives a first rod 176A, 176B, 176C, and 176D, respectively.

In one exemplary embodiment, the cushioned device 112 comprises a filler 182. The filler 182 is disposed within a cavity 184 created by and between the first panel 114 and the second panel 116. The filler 182 comprises a substance that fills the cavity 184. In one embodiment, the filler 182 is foam. In another embodiment, the filler 182 is memory foam.

The cushioned device 112 is disposed vertically relative to the stationary table 106. In one embodiment, the cushioned device 112 is placed on the flat, slab-like top 108 of the stationary table 106. In one embodiment, the cushioned device 112 comprises magnets that hold the cushioned device 112 in place relative to the stationary table 106.

In the embodiments shown in the figures, the cushioned device 112 is rectangular in shape. However, in other exemplary embodiments, the cushioned device 112 may be circular or square in shape or other shapes as shown in FIGS. 22A-D, and 28A-C.

In one exemplary embodiment, the cushioned device 112 includes a cover that is placed over the cushioned device 112. The cover can protect the cushioned device 112 from being exposed to unwanted conditions. In one embodiment, the cover comprises a conformable material. In another embodiment, the cover is composed of fire-retardant material so as to protect the cushioned device 112 from burning. In a further embodiment, the cover is washable.

In one embodiment, the cushioned device 112 is as wide as a surface upon which the cushioned device 112 may be placed. The cushioned device 112 may be antimicrobial or antifouling. The cushioned device 112 may be coated with an antimicrobial or antifouling coating. The cushioned device 112 may be formed by being casted into a mold. The cushioned device 112 may be formed by being cast with an antimicrobial or antifouling material. The antifouling material may be useful to prevent bacterial or microbial growth on the cushioned device 112.

Figure 9A:
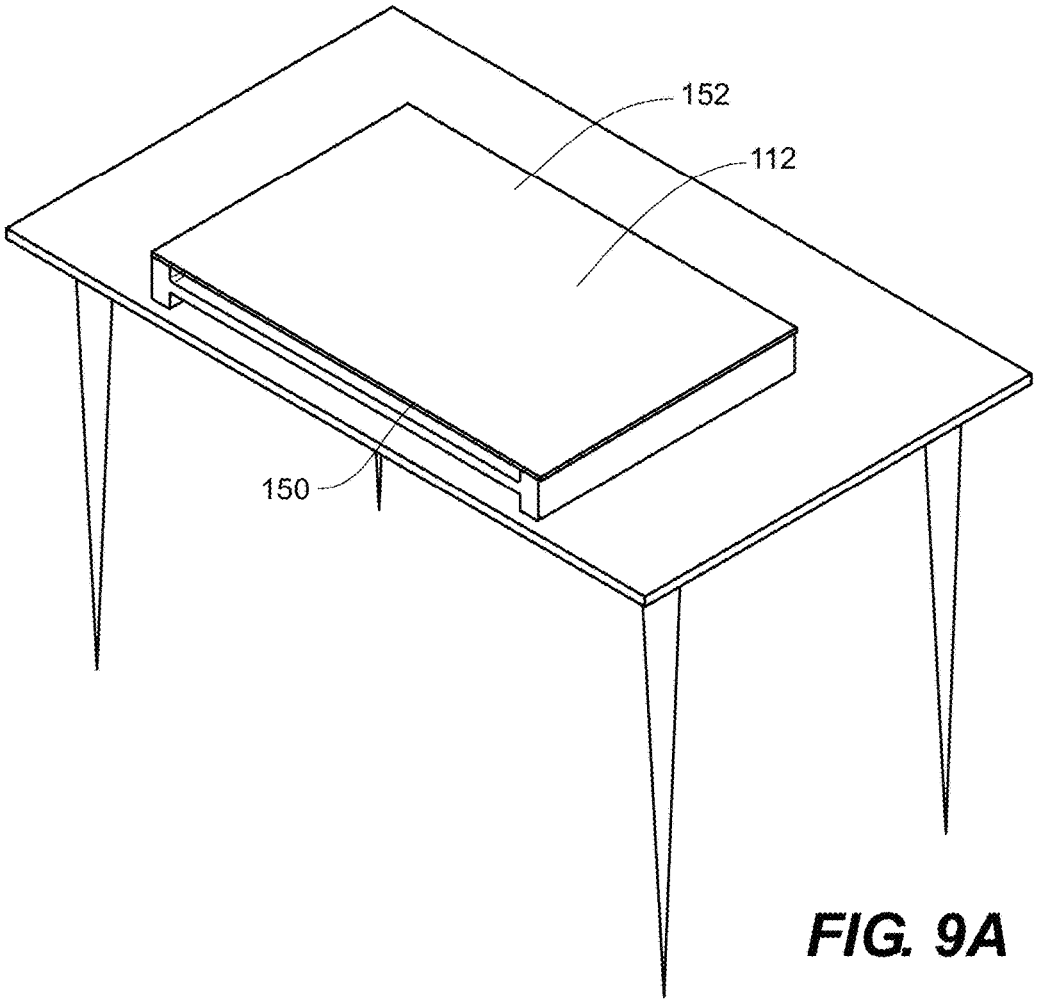
FIG. 9A is a perspective view of a surface-top assembly according to one embodiment of the present disclosure.
Figure 9B:
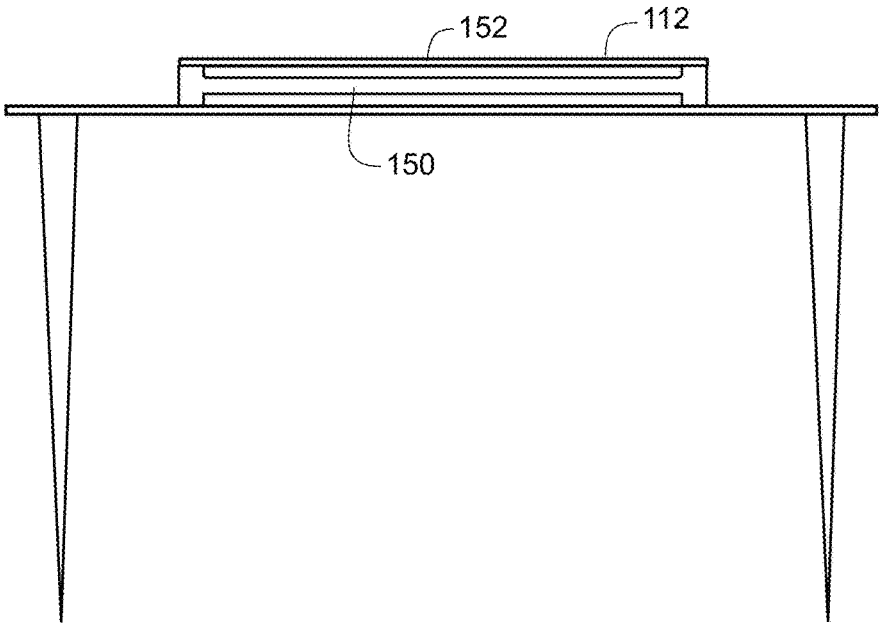
FIG. 9B is a front view of a surface-top assembly according to one embodiment of the present disclosure.
Figure 10A:
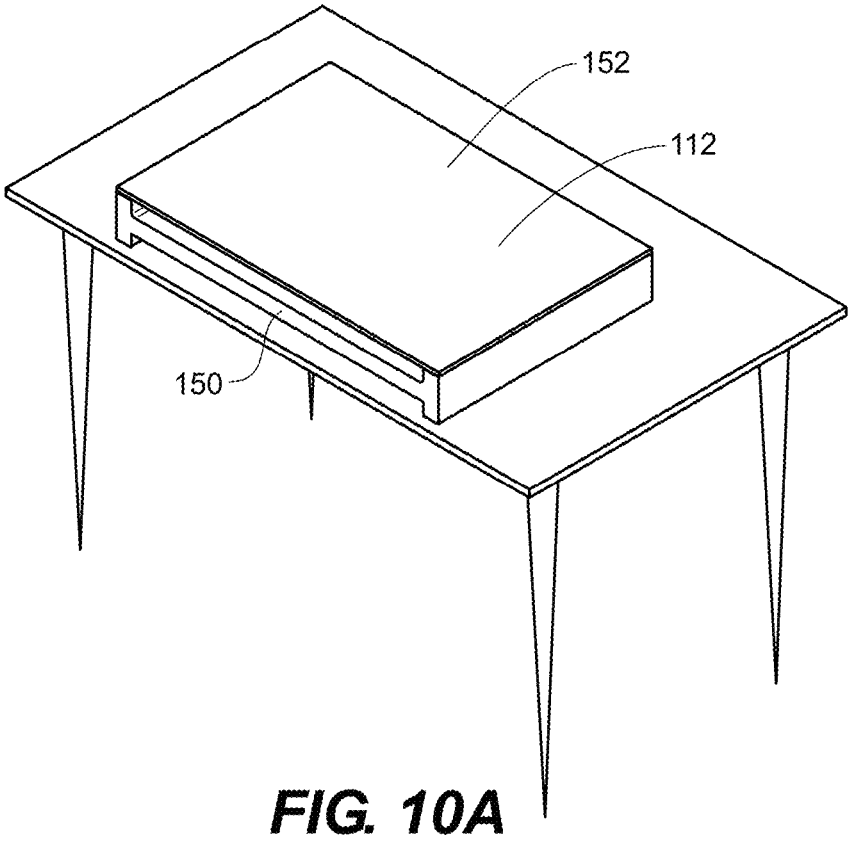
FIG. 10A is a perspective view of a surface-top assembly according to one embodiment of the present disclosure.
Figure 10B:
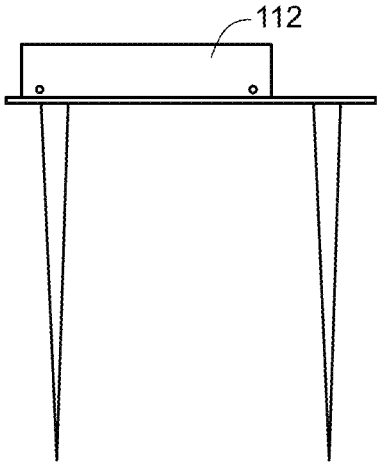
FIG. 10B is a side view of a surface-top assembly according to one embodiment of the present disclosure.
Figure 10C:
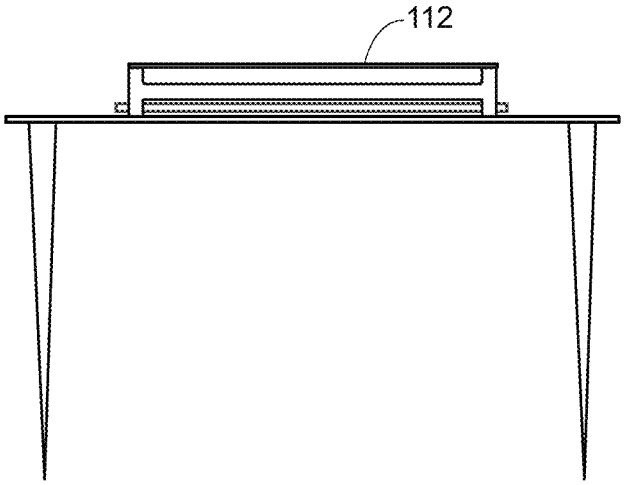
FIG. 10C is a front view of a surface-top assembly according to one embodiment of the present disclosure.
Figure 11A:
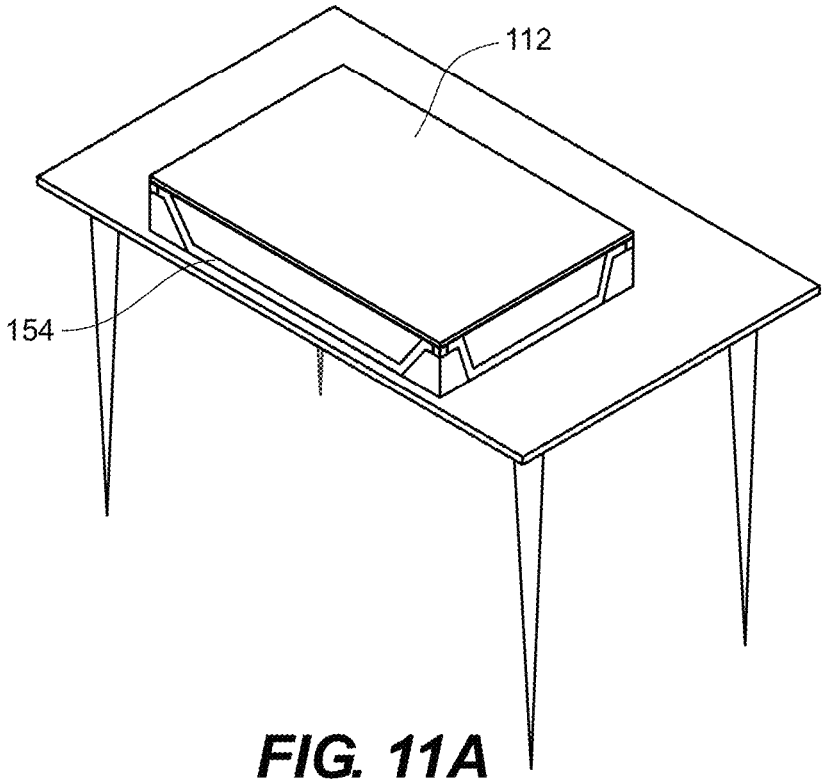
FIG. 11A is a perspective view of a surface-top assembly according to one embodiment of the present disclosure.
Figure 11B:
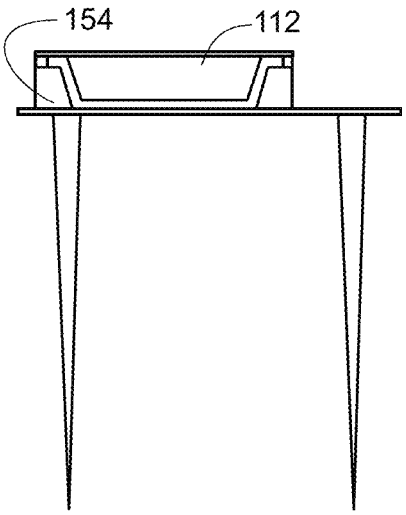
FIG. 11B is a side view of a surface-top assembly according to one embodiment of the present disclosure.
Figure 11C:
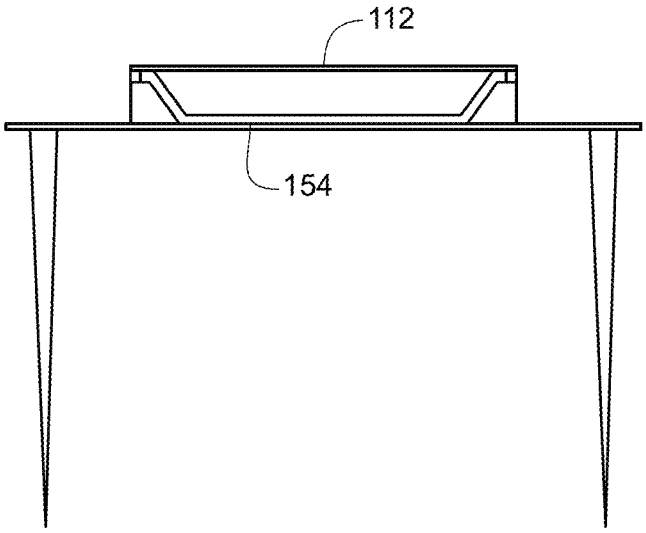
FIG. 11C is a front view of a surface-top assembly according to one embodiment of the present disclosure.
Figure 12A:
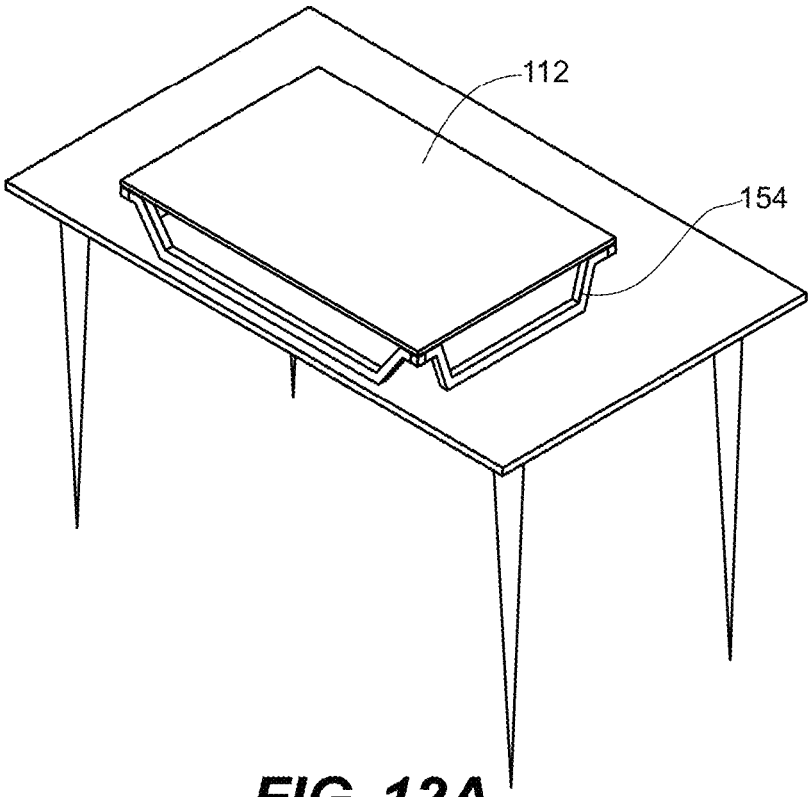
FIG. 12A is a perspective view of a surface-top assembly according to one embodiment of the present disclosure.
Figure 12B:
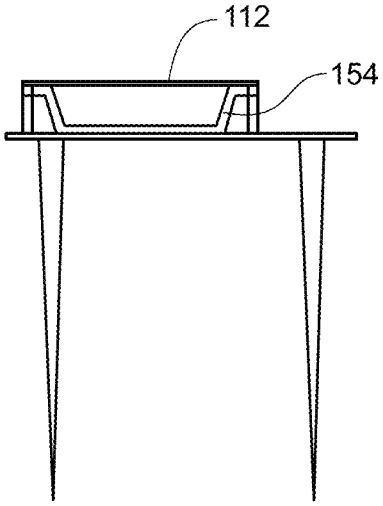
FIG. 12B is a side view of a surface-top assembly according to one embodiment of the present disclosure.
Figure 12C:
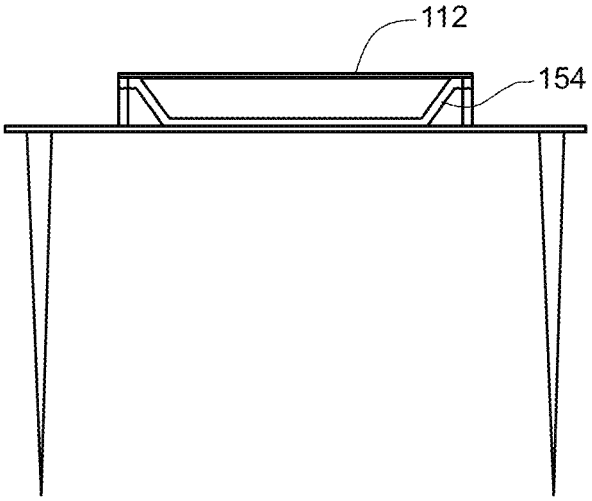
FIG. 12C is a front view of a surface-top assembly according to one embodiment of the present disclosure.
Figure 13A:
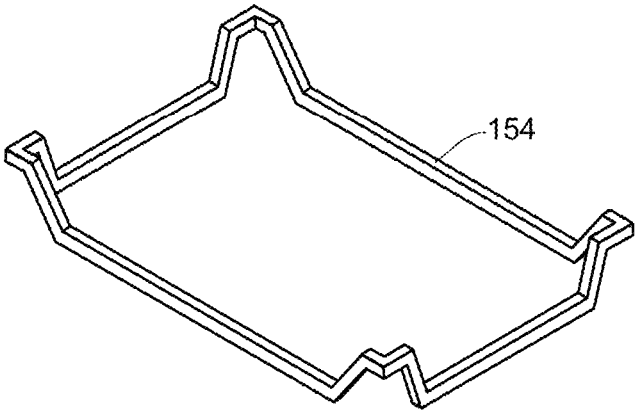
FIG. 13A is a perspective view of a component of a cushioned device according to one embodiment of the present disclosure.
Figure 13B:
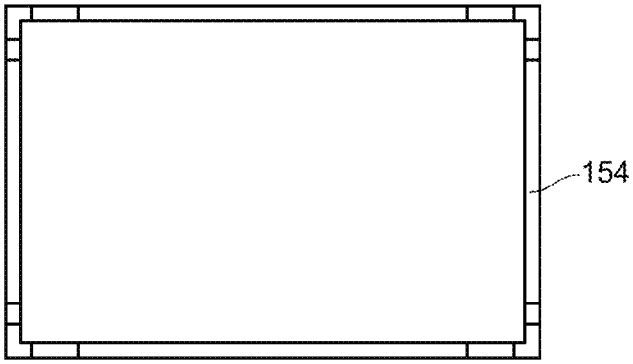
FIG. 13B is a top view of a component of a cushioned device according to one embodiment of the present disclosure.
Figure 13C:
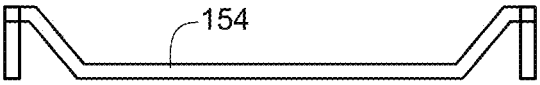
FIG. 13C is a side view of a component of a cushioned device according to one embodiment of the present disclosure.
Figure 14A:
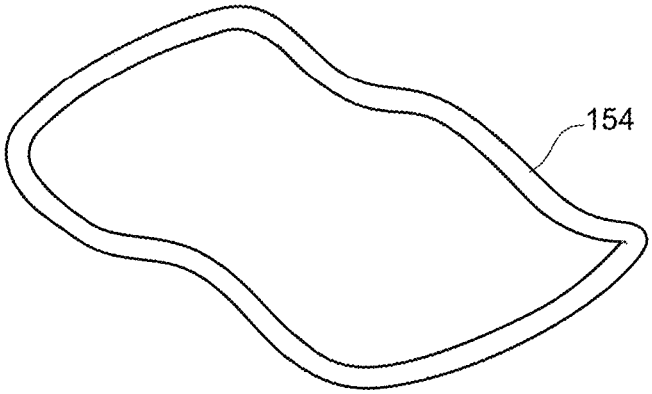
FIG. 14A is a perspective view of a component of a cushioned device according to one embodiment of the present disclosure.
Figure 14B:
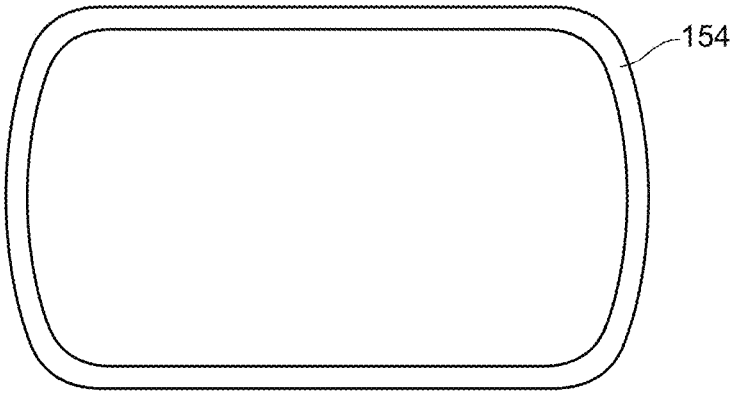
FIG. 14B is a top view of a component of a cushioned device according to one embodiment of the present disclosure.
Figure 14C:
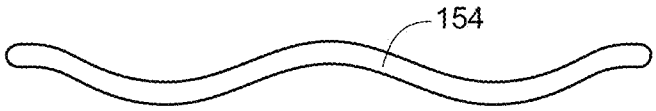
FIG. 14C is a front view of a component of a cushioned device according to one embodiment of the present disclosure.
Figure 14D:
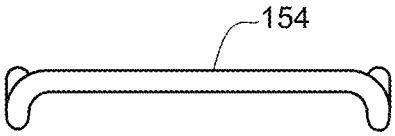
FIG. 14D is a side view of a component of a cushioned device according to one embodiment of the present disclosure.
Figure 15A:
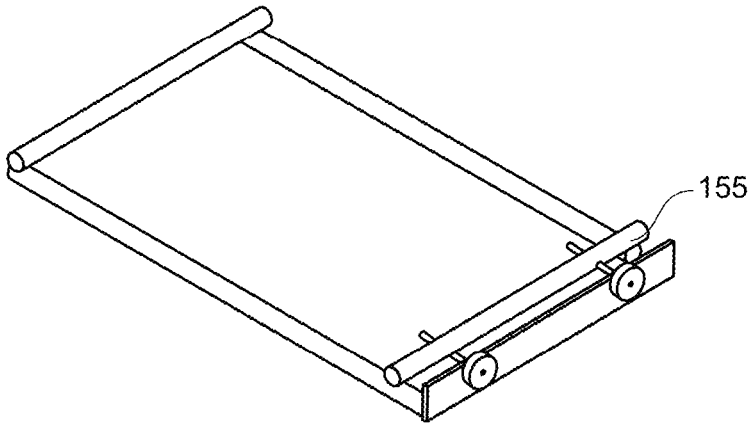
FIG. 15A is a perspective view of a component of a cushioned device according to one embodiment of the present disclosure.
Figure 15B:
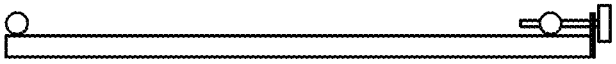
FIG. 15B is a top view of a component of a cushioned device according to one embodiment of the present disclosure.
Figure 15C:
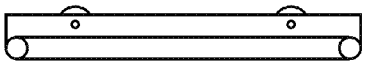
FIG. 15C is a front view of a component of a cushioned device according to one embodiment of the present disclosure.
Figure 15D:
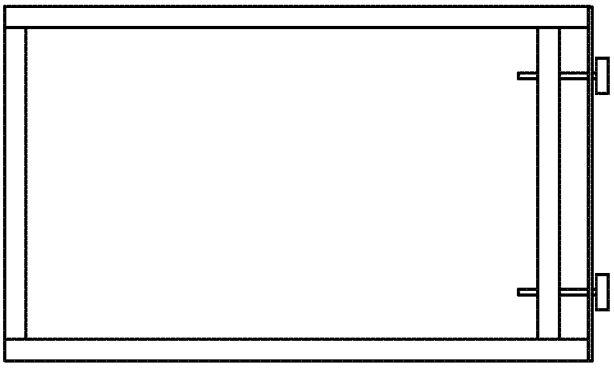
FIG. 15D is a side view of a component of a cushioned device according to one embodiment of the present disclosure.
Figure 16A:
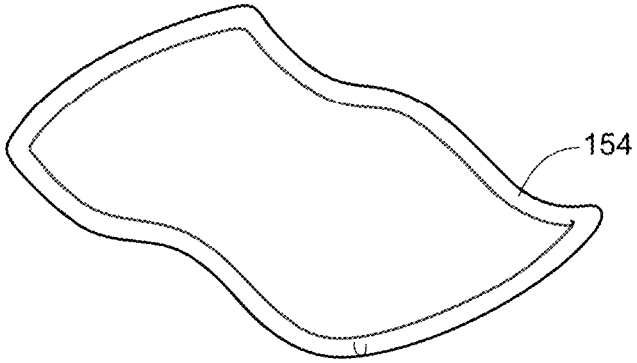
FIG. 16A is a perspective view of a component of a cushioned device according to one embodiment of the present disclosure.
Figure 16B:
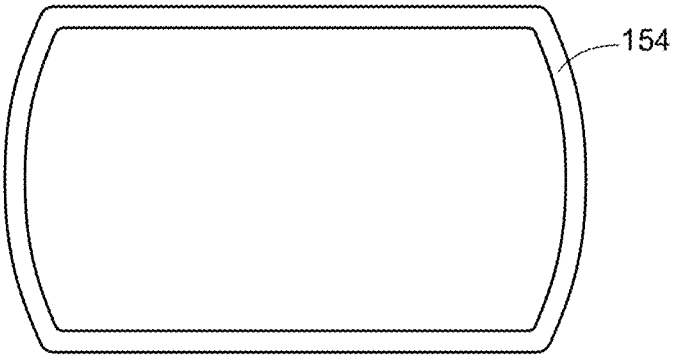
FIG. 16B is a top view of a component of a cushioned device according to one embodiment of the present disclosure.
Figure 16C:
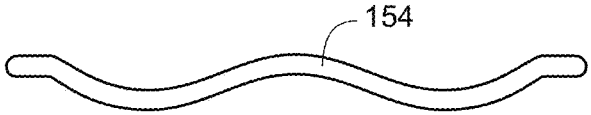
FIG. 16C is a front view of a component of a cushioned device according to one embodiment of the present disclosure.
Figure 16D:
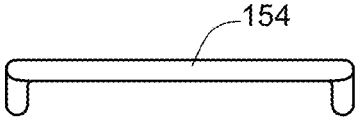
FIG. 16D is a side view of a component of a cushioned device according to one embodiment of the present disclosure.
Figure 17A:
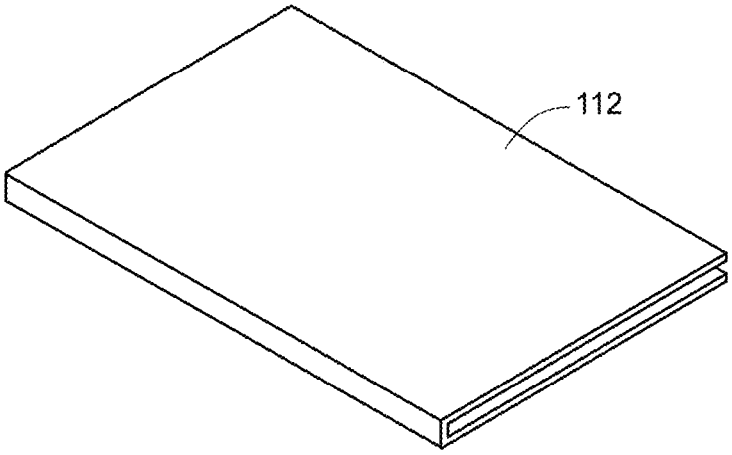
FIG. 17A is a perspective view of a cushioned device according to one embodiment of the present disclosure.
Figure 17B:
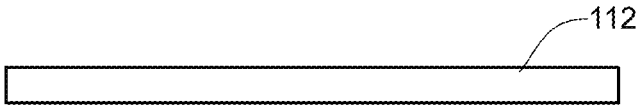
FIG. 17B is a top view of a cushioned device according to one embodiment of the present disclosure.
Figure 17C:
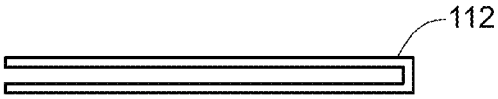
FIG. 17C is a front view of a cushioned device according to one embodiment of the present disclosure.
Figure 17D:
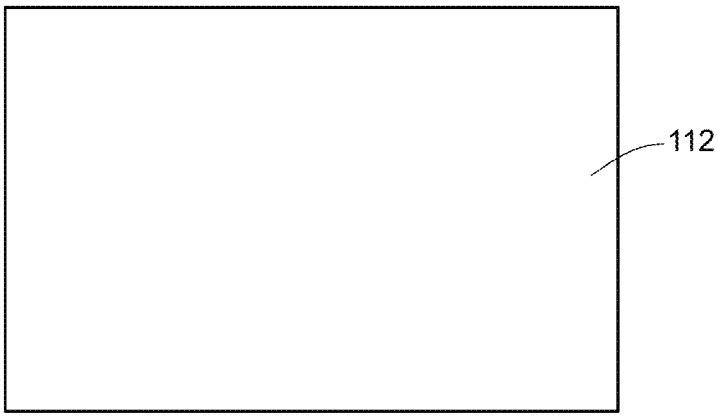
FIG. 17D is a side view of a cushioned device according to one embodiment of the present disclosure.
Figure 18A:
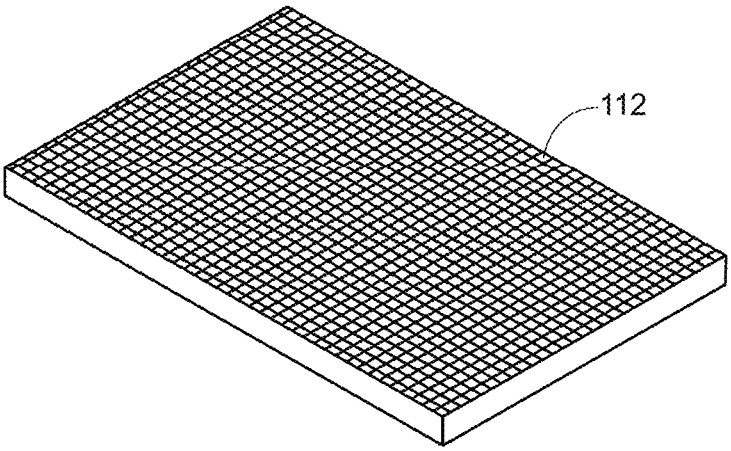
FIG. 18A is a perspective view of a cushioned device according to one embodiment of the present disclosure.
Figure 18B:
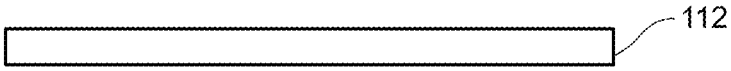
FIG. 18B is a front view of a cushioned device according to one embodiment of the present disclosure.
Figure 18C:
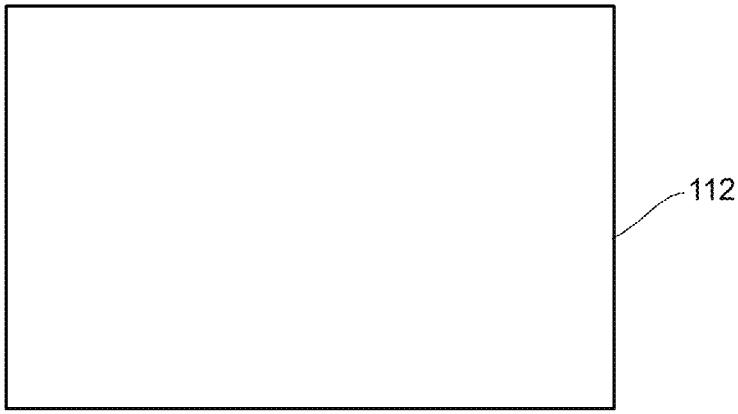
FIG. 18C is a top view of a cushioned device according to one embodiment of the present disclosure.
Figure 18D:
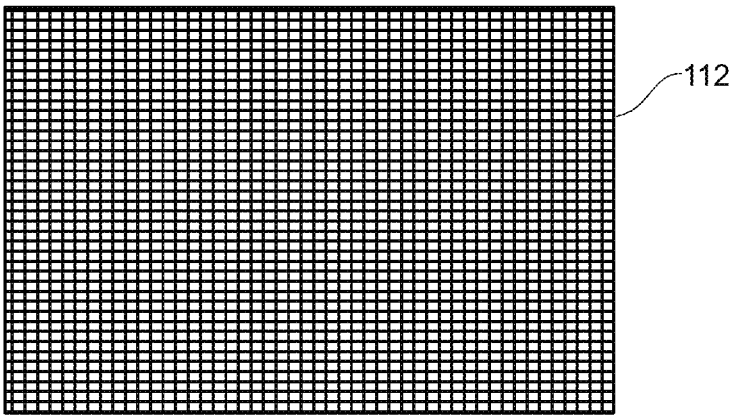
FIG. 18D is a top view of a cushioned device according to one embodiment of the present disclosure.
Figure 19A:
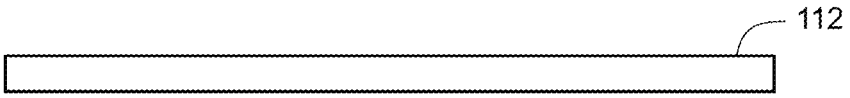
FIG. 19A is a front view of a cushioned device according to one embodiment of the present disclosure.
Figure 19B:
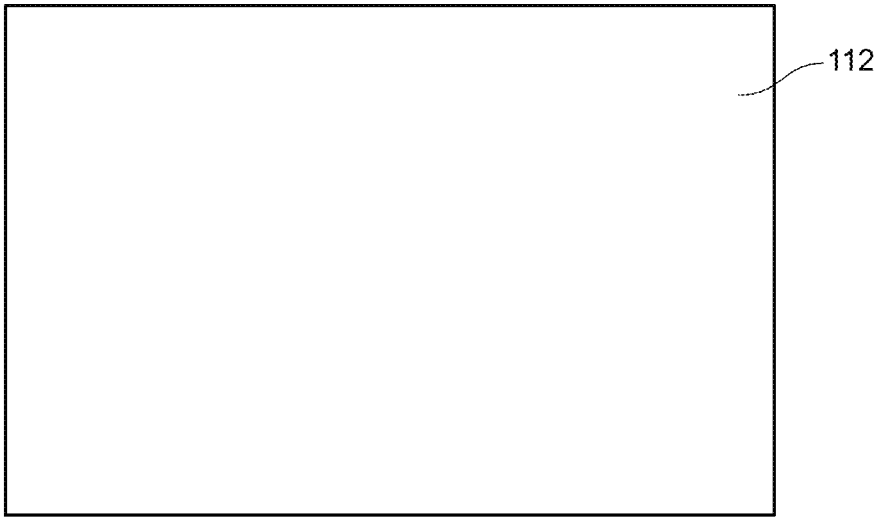
FIG. 19B is a bottom view of a cushioned device according to one embodiment of the present disclosure.
Figure 19C:
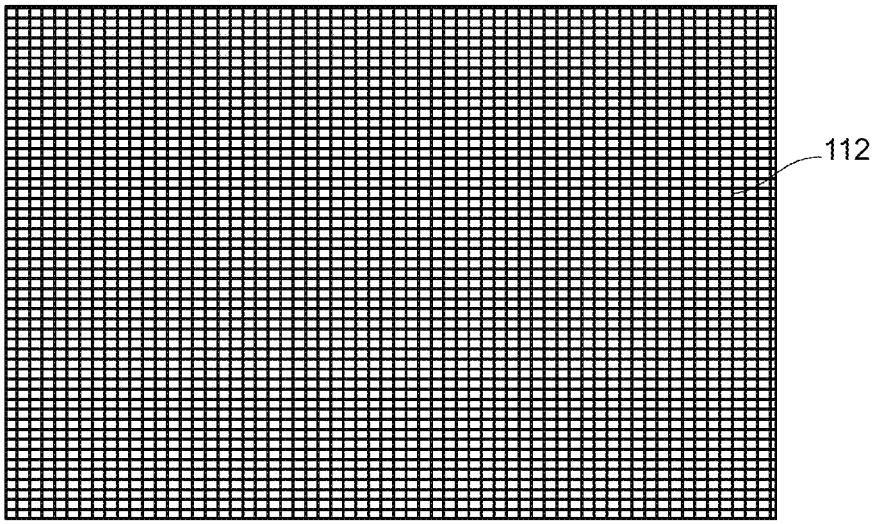
FIG. 19C is a top view of a cushioned device according to one embodiment of the present disclosure.

As shown in FIGS. 9 and 10 the cushioned device 112 can include a string 152 on the upper side and a tensile member 150 on the bottom side. The tensile member can create balance. The tensive member can be, for example, a threaded rod. In one embodiment, the cushioned device 112 includes a plurality of screws configured to make the cushioned device 112 tighter. The plurality of screws can be coupled to a rod.

In an exemplary embodiment, the cushioned device 112 may include one or more integrated bottom boards as shown in FIGS. 23A-D. The integrated bottom board can allow the cushioned device 112 to be moved easily. The integrated bottom board may comprise different levels of stiffness and/or weight so as to accommodate sizes and shapes for or of various users. In one embodiment, the integrated bottom board includes one or a plurality of feet coupled to a bottom portion of the integrated bottom board. The feet can be composed of rubber. In another embodiment, the integrated bottom board can include one or a plurality of handles. In yet another embodiment, the cushioned device 112 includes corners that are sewn in. In a further embodiment, the cushioned device 112 includes one or a plurality of openings to receive one or a plurality of embedded electronics. In another embodiment, the cushioned device 112 may include one or a plurality of batteries coupled to the bottom of the cushioned device 112. In one embodiment, the cushioned device comprises an electrical system having an electrical cable that can transmit power from an outlet to the cushioned device and/or any onboard electronics. In one embodiment the cushioned device may further be comprised of a builtin multi-outlet receptacle providing one or more useful voltages, such as, for example, 120 AC Volts, 12 DC Volts, 5 DC Volts.

In one exemplary embodiment, the cushioned device 112 includes one or a plurality of adjustable legs that protract from the bottom portion of the cushioned device 112. The adjustable legs can detach, attach, and reattach in order to switch from a desk embodiment into a table embodiment.

In another exemplary embodiment, the cushioned device 112 includes a stitching mechanism. The stitching mechanism is depicted along one of dashed lines. The stitching mechanism may form a pattern in the shape of a letter "U" which is turned 90 degrees counterclockwise.

In one embodiment, the cushioned device 112 includes a rod. The rod may be a bar that is formed from a variety of materials, such as, for example, wood or plastic. The rod may be sown in to allow the cushioned device 112 to be rolled up. Moreover, the rod may prevent the cushioned device 112 from rolling over. When the rod is embedded into the cushioned device 112, the cushioned device 112 is stiffened so as to prevent unwanted bending. The rod may be embedded in either end or both ends of the cushioned device 112.

In an exemplary embodiment, the rod is removable, thereby allowing the cushioned device 112 to be used for sleeping. For example, the cushioned device 112 can be 1 to 2 inches thick so as to provide enough cushion and or support for sleeping. In a similar example, the cushioned device 112 can be 20 inches by 36 inches. In one embodiment, the cushioned device 112 can be segmented into a plurality of 1 inch by 1 inch apertures, all or some of which may extend all the way or partially through the cushioned device from one or both sides. Where apertures extend partially through the cushioned device, they may terminate at a septum located within the cushion device that may or may not coincide with the midline of the device. The apertures may, for example, be shaped as squares. However, it should be noted that apertures of any shape and or size may affect the physical or thermal properties of the cushion. For example, increasing a volume of air within each of the plurality of apertures may affect the thermal properties by allowing for a greater level of convective heat transfer between an electronic device and the atmosphere than a cushion with a continuous surface.

Figure 25A:
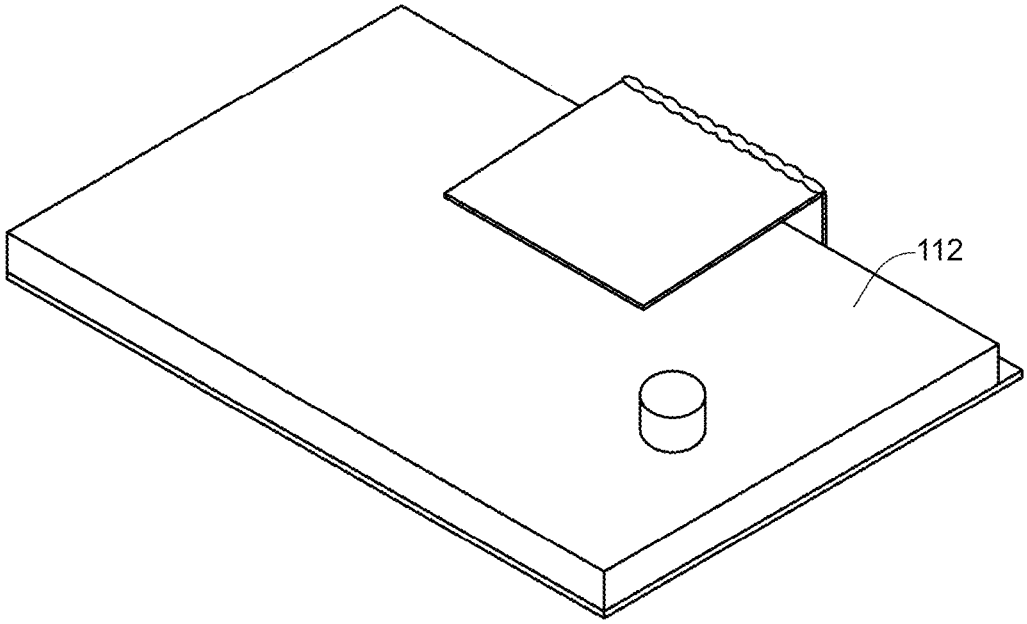
FIG. 25A is a perspective view of a cushioned device according to one embodiment of the present disclosure.
Figure 25B:
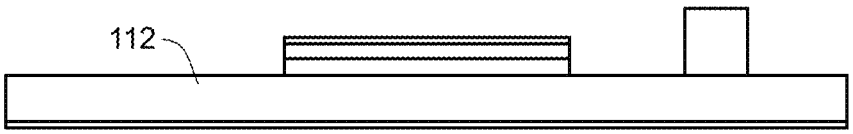
FIG. 25B is a front view of a cushioned device according to one embodiment of the present disclosure.
Figure 25C:
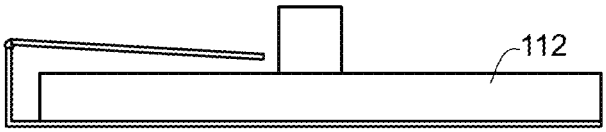
FIG. 25C is a side view of a cushioned device according to one embodiment of the present disclosure.

In a further exemplary embodiment, the cushioned device 112 includes an accessory mechanism. The accessory mechanism can receive one or more electronics as shown in FIGS. 25A-C. The accessory mechanism can prevent the one or more electronics from overheating. This may be particularly useful for gaming or engineering computers which need to manage heat transfer. In one embodiment, the accessory mechanism can be segmented into a plurality of sections. Each of the plurality of sections can receive a heat dissipator. The heat dissipator may be circular in shape. In another embodiment, the accessory mechanism can include a concrete, solid bottom surface that is not segmented, but still dissipates heat. In a further embodiment, a fan can be placed in an interior of the heat dissipator in order to manage air inflow and outflow.

In another embodiment, as shown in FIGS. 11A-14D and 16A-D, the bottom of the cushioned device 112 includes a detachable stand 154. The detachable stand is received by a rear-most portion of the bottom of the cushioned device 112. The detachable stand can flip up or down. The detachable stand can be foldable. The detachable stand can include a riser that causes a laptop to enter an upright position and move vertically upwards.

In one exemplary embodiment, as depicted in FIGS. 15A-D, the cushioned device 112 can include a tension fabric. The tension fabric can be disposed on the top of the cushioned device 112. The tension fabric may be connected to a tensioning mechanism 155. The tensioning mechanism can be foldable or collapsible. The tensioning mechanism can include a press fit. The tensioning mechanism can include a heat shrink. The tensioning mechanism can include a material that has been pre-strained.

In an exemplary embodiment, the cushioned device 112 can include a threaded tensioning rod. The rod can be placed immediately below a central support. The rod can cause fabric used in connection with the cushioned device 112 to tighten up so that the arm of the user will not sink all the way or most of the way through the cushioned device.

Figure 26:
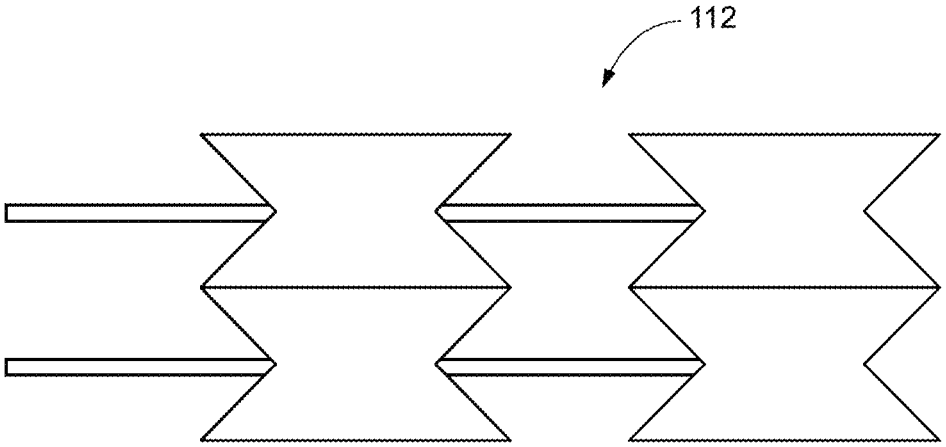
FIG. 26 is a side view of a component of a cushioned device according to one embodiment of the present disclosure.

In one embodiment shown in FIG. 26, the cushioned device 112 can utilize foam such as, for example, memory foam or temperature-sensitive foam. The foam can be auxetic, thereby having a negative poisson ratio in order to maximize the cushioning effect of the cushioning device, which prevents the cushion from "bottoming out," under load. The foam can include canvas. The embodiment shown in FIG. 26 causes the auxetic foam to crowd around a finger, the hand, and/or the forearm of the user instead of spreading out and going away from the finger, the hand or the forearm placed thereon. Auxetic materials may be additively manufactured, extruded, or manufactured by other means that would produce the auxetic materials. The filler may also comprise a mesh top and bottom with a filament disposed between.

In one exemplary embodiment, the cushioned device 112 can be hybrid: including both foam and a frame. The cushioned device 112 can include a tensioned material on the top. The cushioned device 112 can include a replaceable top. The replaceable top can be snapped in or out. When the replaceable top is snapped out, the foam inside the cushioned device 112 can be replaced as necessary. In another embodiment, the cushioned device 112 can be comprised of a tension fabric within the foam. In another embodiment, a renewable top may be comprised of one or more peelable layers. In one embodiment, a tensioned material may be tensioned by first attaching it to a frame, which is coupled to the tensioned material, and then by deforming the frame to tension the material until a certain deformation is achieved. Provided that the certain deformation is achieved, the frame is unable to pre-deformation state. Because the frame would enter a state of "plastic deformation" and not be able to achieve the pre-deformation state, however, the frame would then enter a state wherein the frame is less deformed than the maximum transitory state of deformation. The frame can be plastically deformed in order to retain a shape that imposes tension on the tensioned material.

Figure 21A:
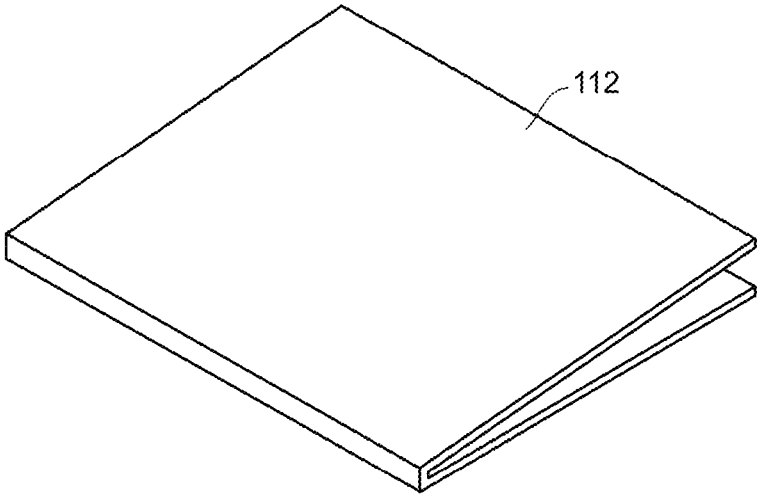
FIG. 21A is a perspective view of a cushioned device according to one embodiment of the present disclosure.
Figure 21B:
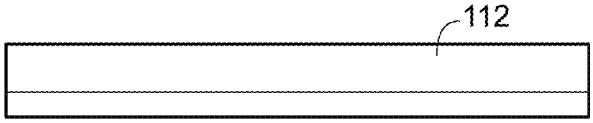
FIG. 21B is a front view of a cushioned device according to one embodiment of the present disclosure.
Figure 21C:
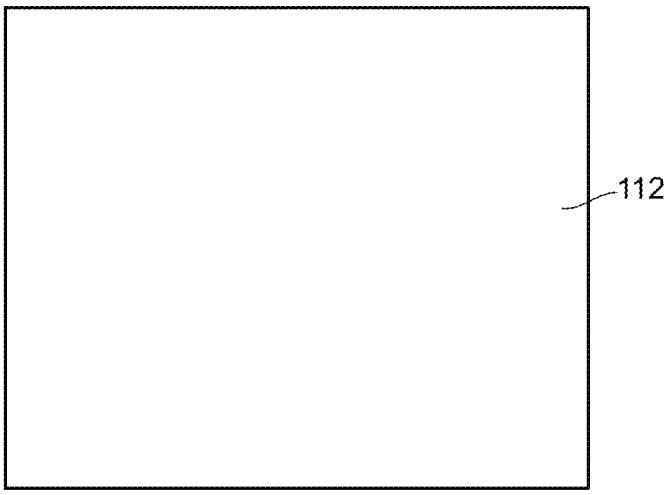
FIG. 21C is a top view of a cushioned device according to one embodiment of the present disclosure.
Figure 21D:
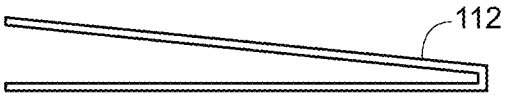
FIG. 21D is a side view of a cushioned device according to one embodiment of the present disclosure.
Figure 22A:
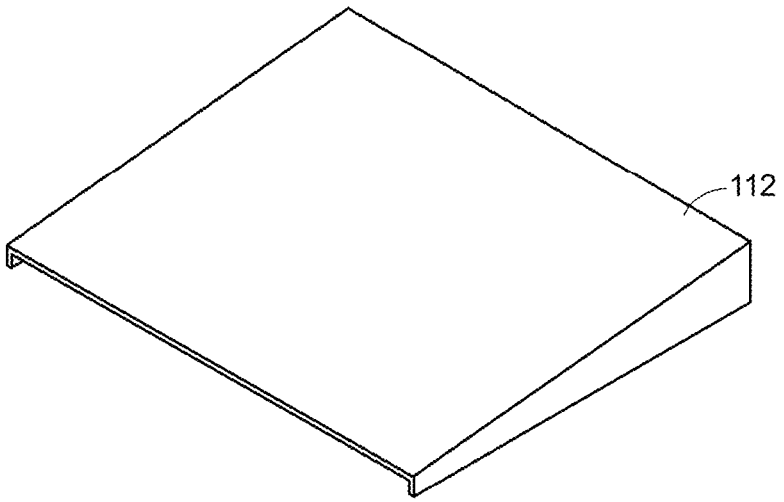
FIG. 22A is a perspective view of a cushioned device according to one embodiment of the present disclosure.
Figure 22B:
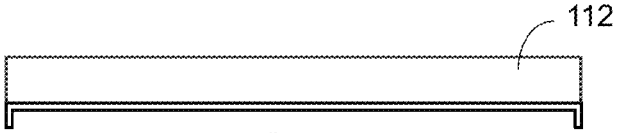
FIG. 22B is a front view of a cushioned device according to one embodiment of the present disclosure.
Figure 22C:
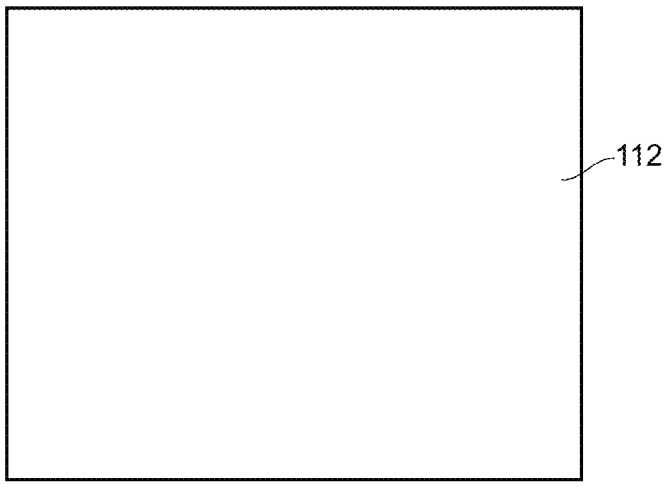
FIG. 22C is a top view of a cushioned device according to one embodiment of the present disclosure.
Figure 22D:
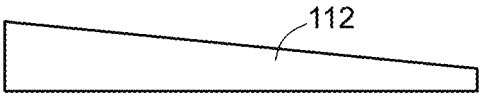
FIG. 22D is a side view of a cushioned device according to one embodiment of the present disclosure.
Figure 23A:
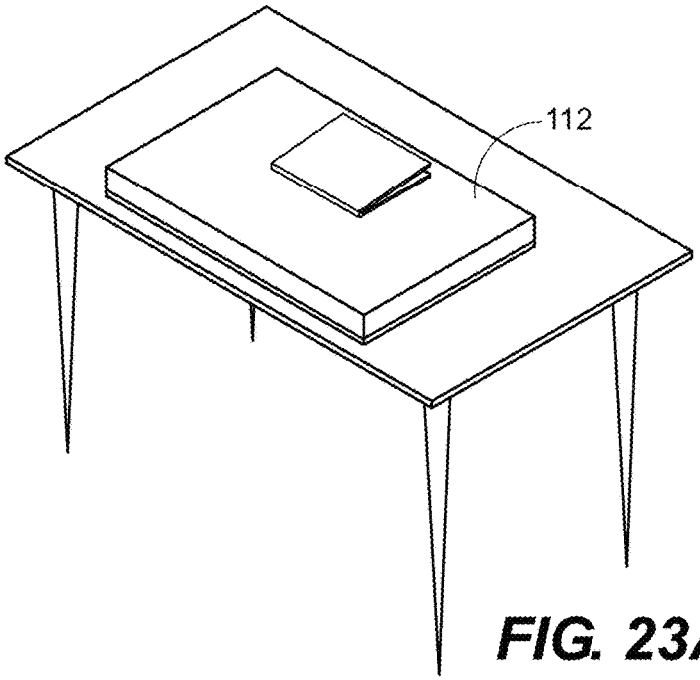
FIG. 23A is a perspective view of a surface-top assembly according to one embodiment of the present disclosure.
Figure 23B:
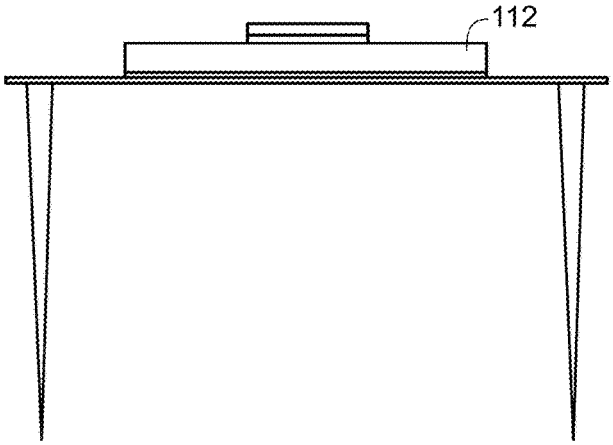
FIG. 23B is a front view of a surface-top assembly according to one embodiment of the present disclosure.
Figure 23C:
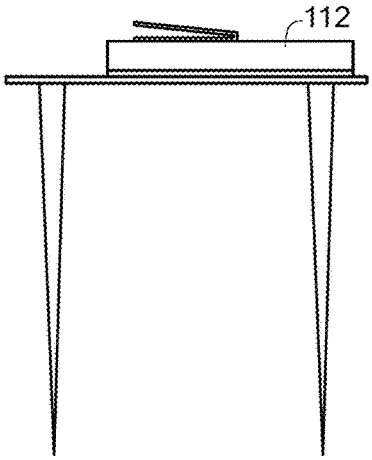
FIG. 23C is a side view of a surface-top assembly according to one embodiment of the present disclosure.
Figure 23D:
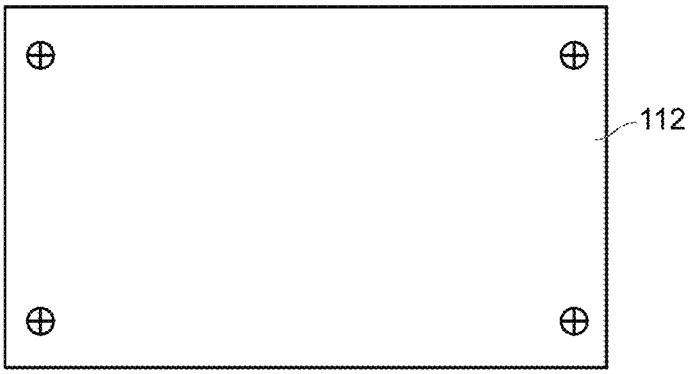
FIG. 23D is a bottom view of a surface-top assembly according to one embodiment of the present disclosure.
Figure 24A:
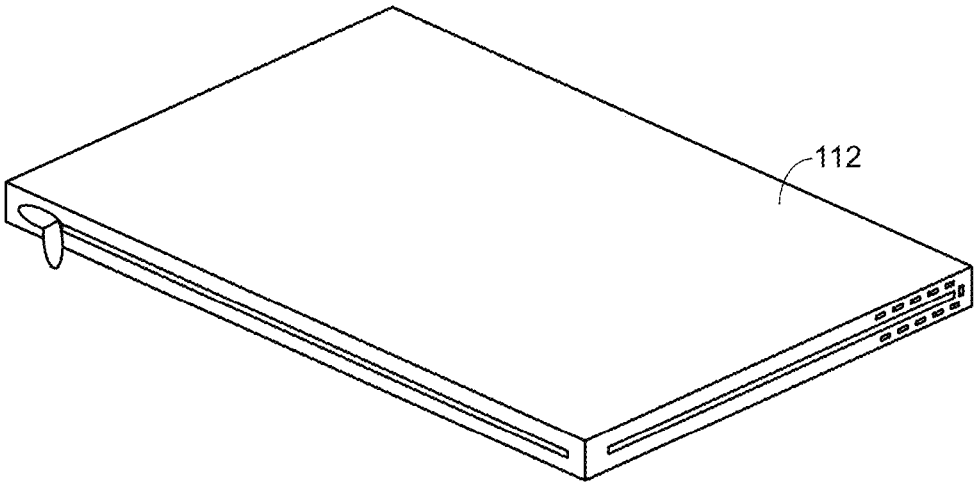
FIG. 24A is a perspective view of a cushioned device according to one embodiment of the present disclosure.
Figure 24B:
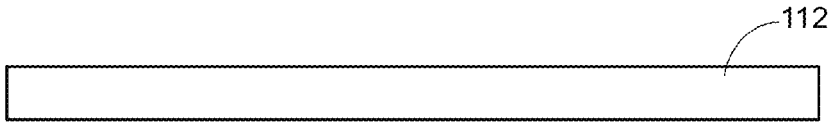
FIG. 24B is a back view of a cushioned device according to one embodiment of the present disclosure.
Figure 24C:
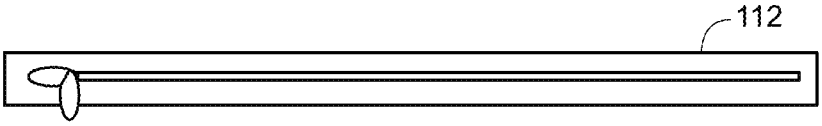
FIG. 24C is a front view of a cushioned device according to one embodiment of the present disclosure.

In another embodiment, the cushioned device 112 can comprise a shell as shown in FIGS. 21A-C. The shell can be composed of material that allows the shell to function just like the cushioned device 112. The shell can be hollow as shown in FIGS. 17A-D. The material used for the shell can deflect but not bottom out. The shell can be made out of composite material, such as, for example, carbon fiber. The embodiment shown in FIG. 9 includes ribs placed inside the cushioned device 112. The ribs are disposed in between the top and the bottom of the cushioned device 112 in order to stiffen the cushioned device 112.

Figure 20A:
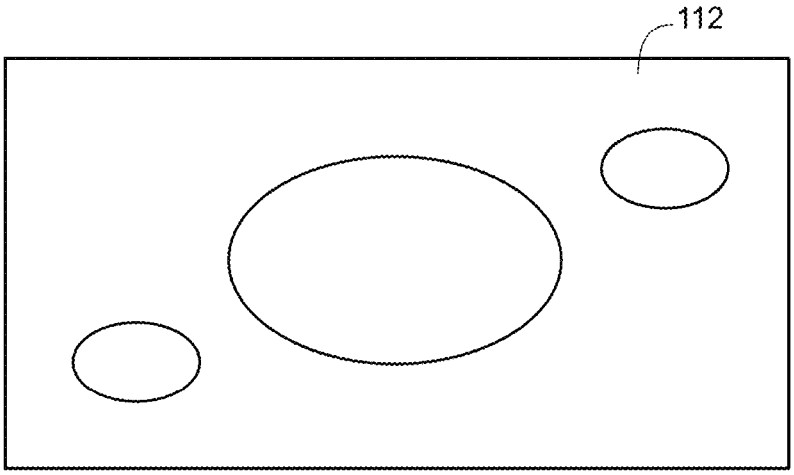
FIG. 20A is a top view of a cushioned device according to one embodiment of the present disclosure.
Figure 20B:
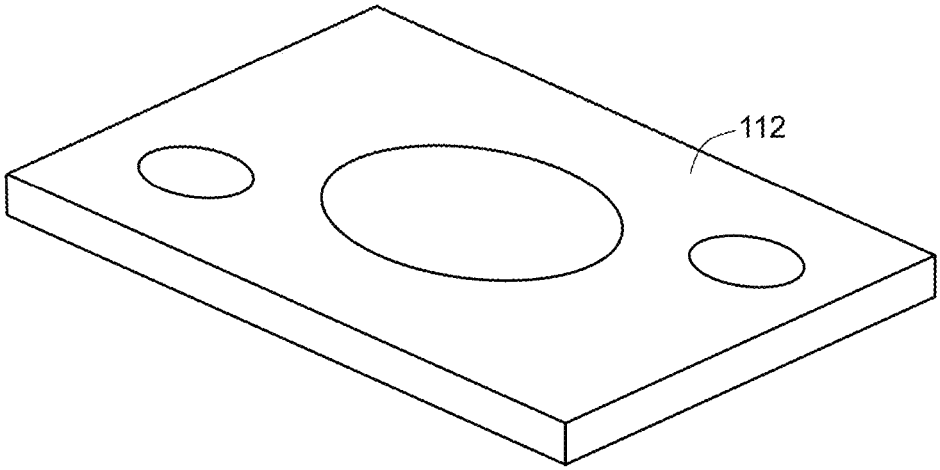
FIG. 20B is a perspective view of a cushioned device according to one embodiment of the present disclosure.
Figure 20C:
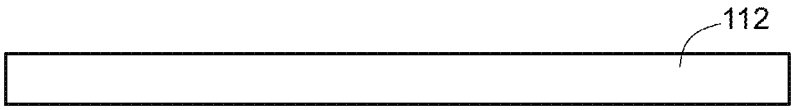
FIG. 20C is a front view of a cushioned device according to one embodiment of the present disclosure.

In one embodiment, the cushioned device 112 include a fill pattern that could vary across a surface of the cushioned device 112 as shown in FIGS. 20A-C. The fill pattern can be denser in some areas but not others. The fill pattern can be used for thermal management and/or to support a load placed on the cushioned device 112. The fill pattern can further be used to express a logo or a graphic.

In another embodiment, the cushioned device 112 can include a plurality of apertures. The apertures can be shaped as squares. The plurality of apertures can extend on the first panel 114 of the cushioned device 112 but not the second panel 116. In this configuration, there may be a longitudinal panel extending from one end of the plurality of apertures so as to allow the cushioned device 112 to be structurally sound. In another embodiment, the plurality of apertures can appear on both the first panel 114 and the second panel 116 of the cushioned device 112 such that a plane opening is formed starting from each of the plurality of apertures on the first panel 114 and all the way through to each of the plurality of apertures on the second panel 116. In yet a further embodiment, the plurality of apertures can extend on the second panel 116 of the cushioned device 112 but not the first panel 114.

Figure 29:
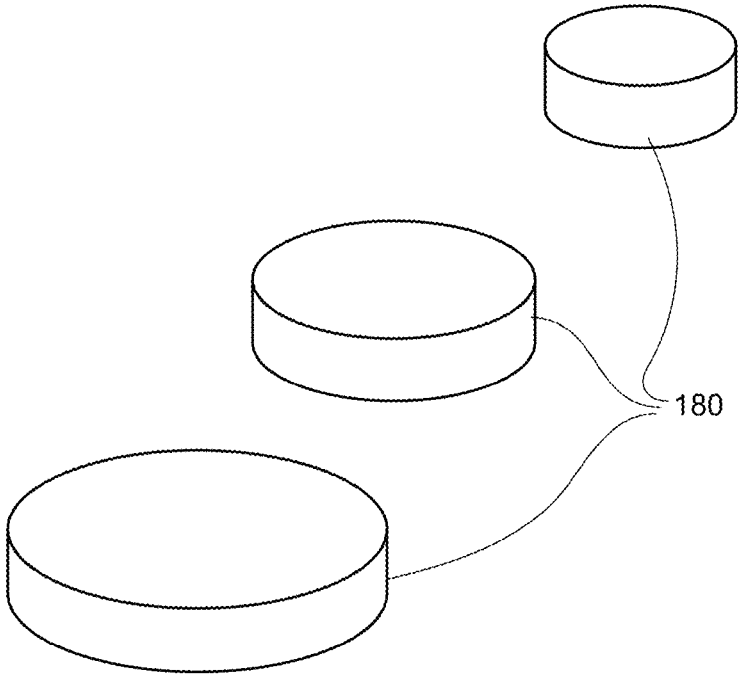
FIG. 29 is a perspective view of a plurality of components of a cushioned device according to one embodiment of the present disclosure.

FIG. 29 depicts a plurality of cushions 180 that may be inserted into the cushioned device 112. The cushions may mitigate effects of weight from the user being placed on the cushioned device 112.

Figure 27A:
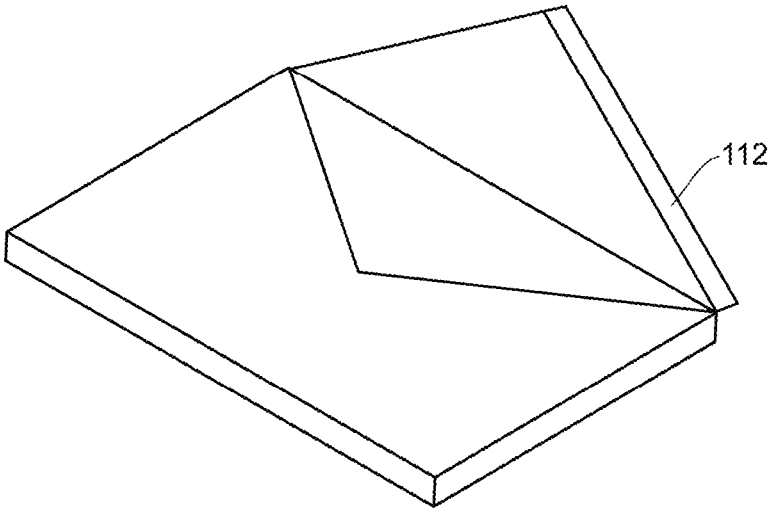
FIG. 27A is a perspective view of a cushioned device according to one embodiment of the present disclosure.
Figure 27B:
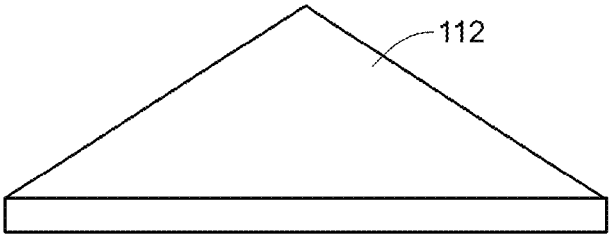
FIG. 27B is a perspective view of a cushioned device according to one embodiment of the present disclosure.
Figure 27C:
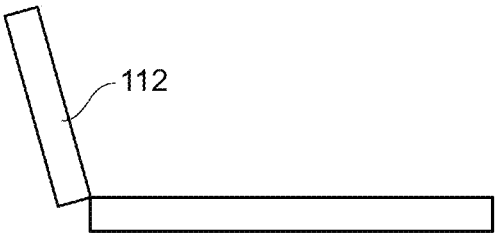
FIG. 27C is a side view of a cushioned device according to one embodiment of the present disclosure.
Figure 28A:
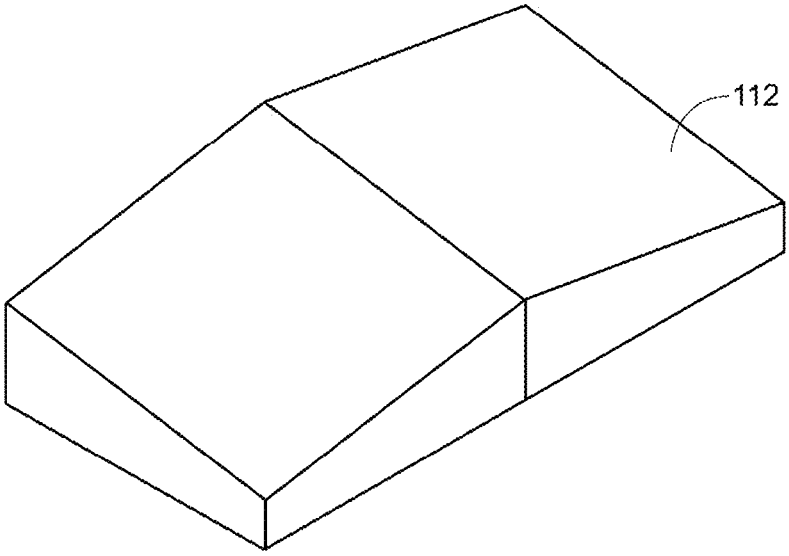
FIG. 28A is a perspective view of a cushioned device according to one embodiment of the present disclosure.
Figure 28B:
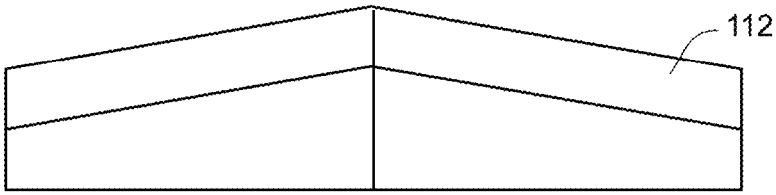
FIG. 28B is a front view of a cushioned device according to one embodiment of the present disclosure.
Figure 28C:
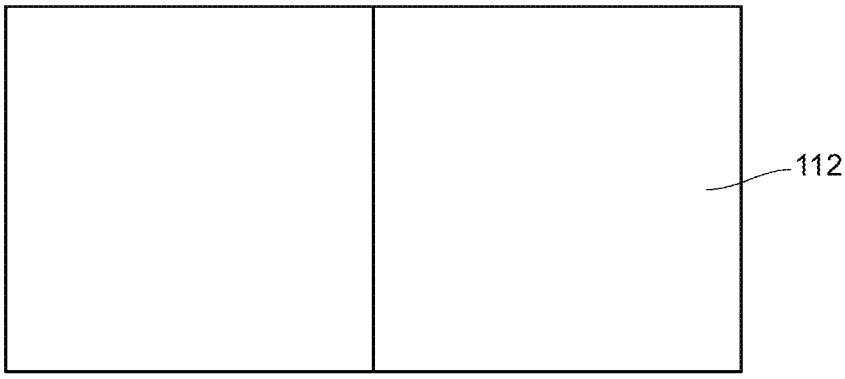
FIG. 28C is a top view of a cushioned device according to one embodiment of the present disclosure.
Figure 30:
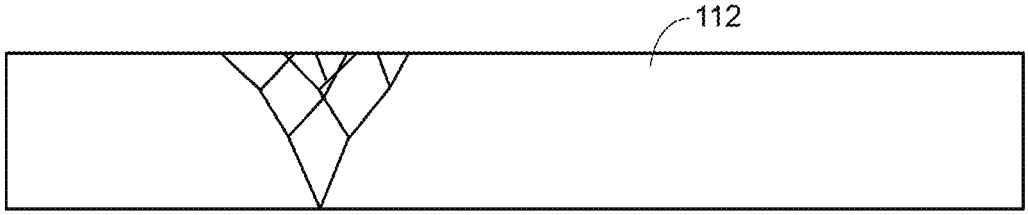
FIG. 30 is a front view of a cushioned device according to one embodiment of the present disclosure.

FIG. 30 shows an exemplary embodiment of the cushioned device 112 wherein the structure of a cushioned device 112 is composed using generative-design techniques as depicted in FIGS. 27A-C. The generative-design techniques used to form the cushioned device 112 can include utilizing a structure that is generatively designed and may be additively manufactured so as to create a structurally-integral and compliant device.

Figure 31:
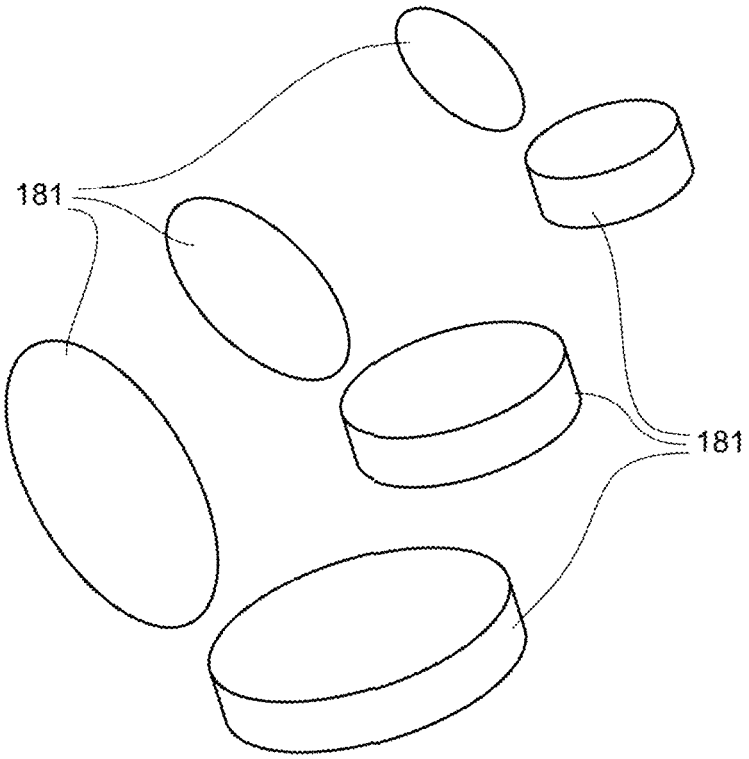
FIG. 31 is a perspective view of a plurality of fillers of a cushioned device according to one embodiment of the present disclosure.

FIG. 31 shows a plurality of cushion segments 181. The cushion segments can be positioned to comprise a personalized cushioned device 112. The cushion segments can be circle in shape. The cushion segments can be coupled to one or a plurality of robots which position and contour the cushion segments according to a pressure received from one or more forearms placed on the cushion segments. In the configuration shown in FIG. 31, there are six cushioned segments 181. The six cushion segments create six areas of contact with the user. In another embodiment, the cushioned device 112 can include nine cushion segments. The nine cushion segments would allow for the creation of nine areas of contact with the user, thereby allowing the upper arm, the forearm, and the hand of the user to be adequately supported in nearly any position.

Figure 32A:
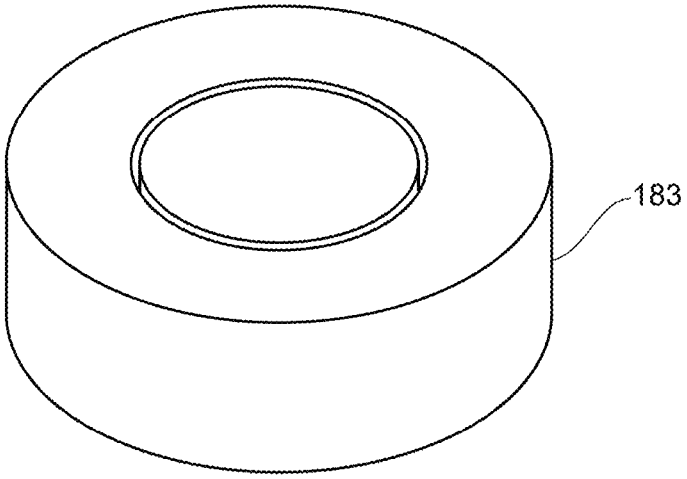
FIG. 32A is a perspective view of a component of a cushioned device according to one embodiment of the present disclosure.
Figure 32B:
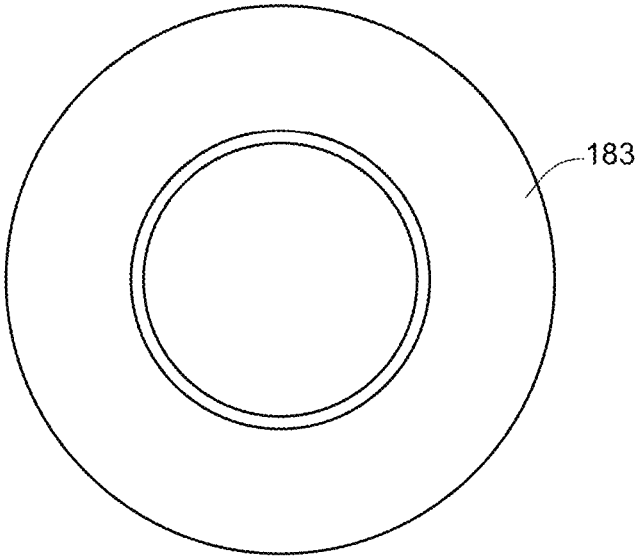
FIG. 32B is a top view of a component of a cushioned device according to one embodiment of the present disclosure.
Figure 32C:
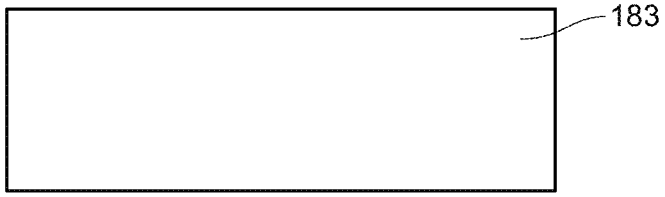
FIG. 32C is a front view of a component of a cushioned device according to one embodiment of the present disclosure.
Figure 33A:
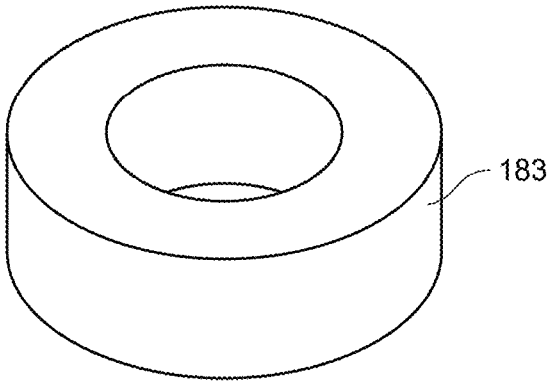
FIG. 33A is a perspective view of a component of a cushioned device according to one embodiment of the present disclosure.
Figure 33B:
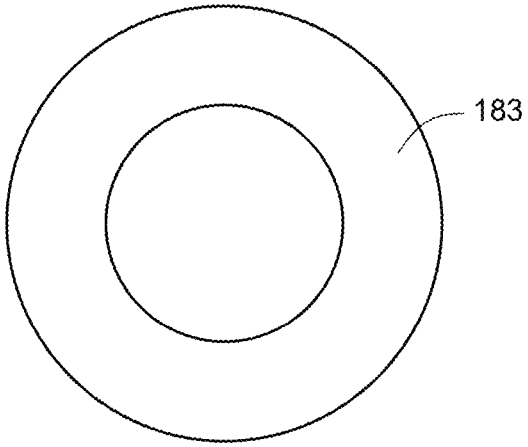
FIG. 33B is a perspective view of a component of a cushioned device according to one embodiment of the present disclosure.
Figure 33C:
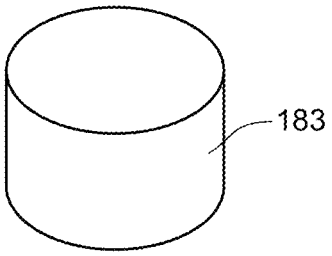
FIG. 33C is a top view of a component of a cushioned device according to one embodiment of the present disclosure.
Figure 33D:
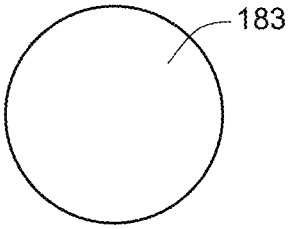
FIG. 33D is a top view of a component of a cushioned device according to one embodiment of the present disclosure.

In an exemplary embodiment shown in FIGS. 33A-D, the cushioned device 112 comprises a donut-shaped circle cushion segment 183 and a donut hole cushion segment. The donut-shaped circle cushion segment is greater in size than the donut hole. As shown in FIGS. 32A-C, the donut-shaped circle cushion 183 segment can receive the donut hole by way of an opening extending in a middle portion of the donut-shaped circle cushion segment. The opening in the middle of the donut-shaped circle cushion segment is sized so as to receive the donut hole with minimal clearance therebetween. In the exemplary embodiment shown in FIG. 33, the donut-shaped circle cushion segment can be separated from the donut hole in that the donut hole is not coupled or the donut hole is removably and replaceably coupled to the donut-shaped circle cushion segment.

Figure 34A:
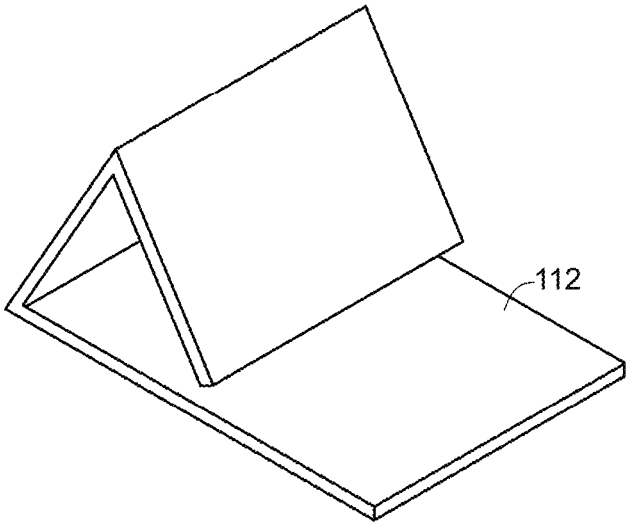
FIG. 34A is a perspective view of a cushioned device according to one embodiment of the present disclosure.
Figure 34B:
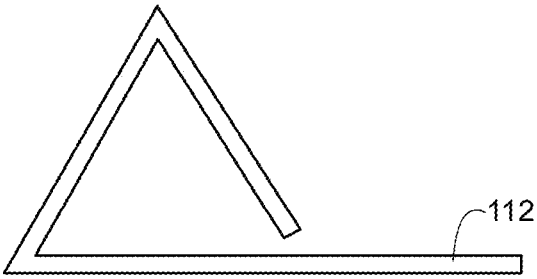
FIG. 34B is a side view of a cushioned device according to one embodiment of the present disclosure.
Figure 34C:
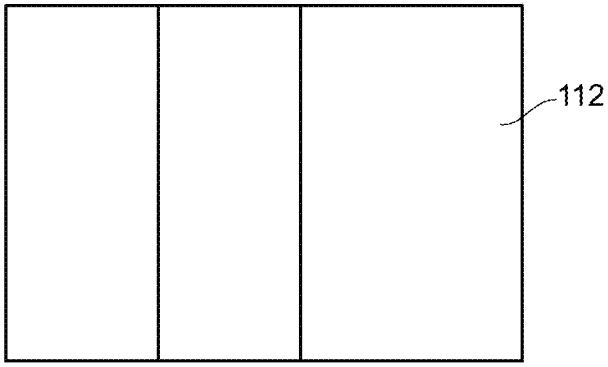
FIG. 34C is a top view of a cushioned device according to one embodiment of the present disclosure.
Figure 35A:
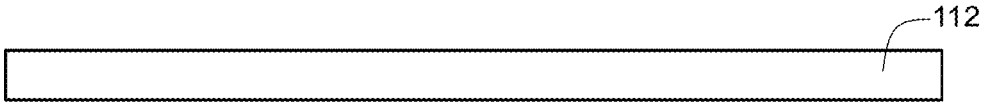
FIG. 35A is a front view of a cushioned device according to one embodiment of the present disclosure.
Figure 35B:
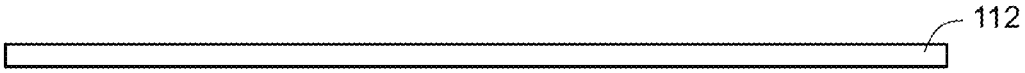
FIG. 35B is a front view of a cushioned device according to one exemplary embodiment of the present disclosure.
Figure 35C:
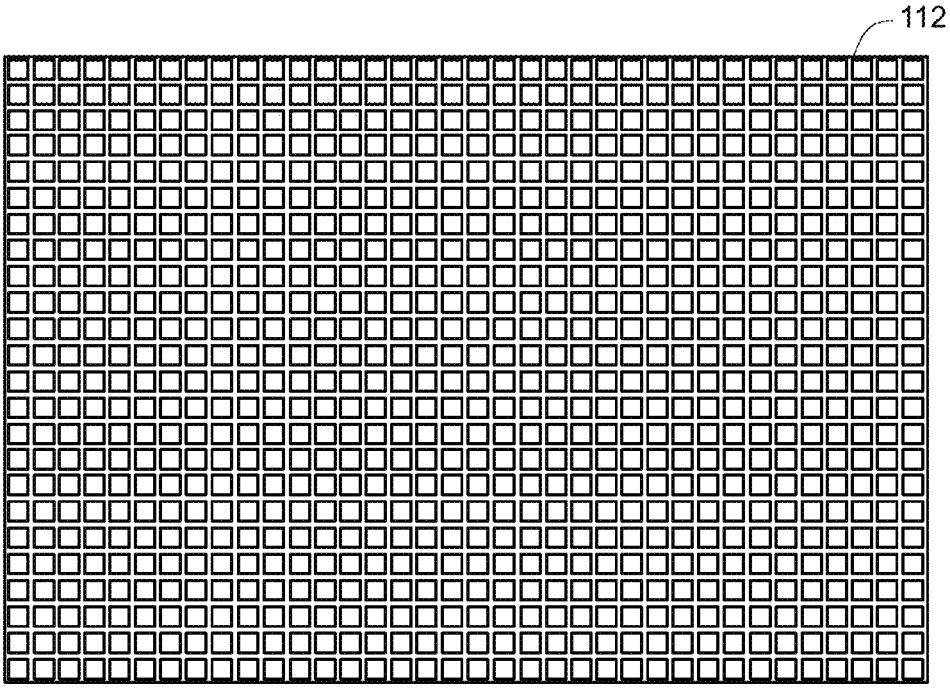
FIG. 35C is a top view of a cushioned device according to one embodiment of the present disclosure.
Figure 36:
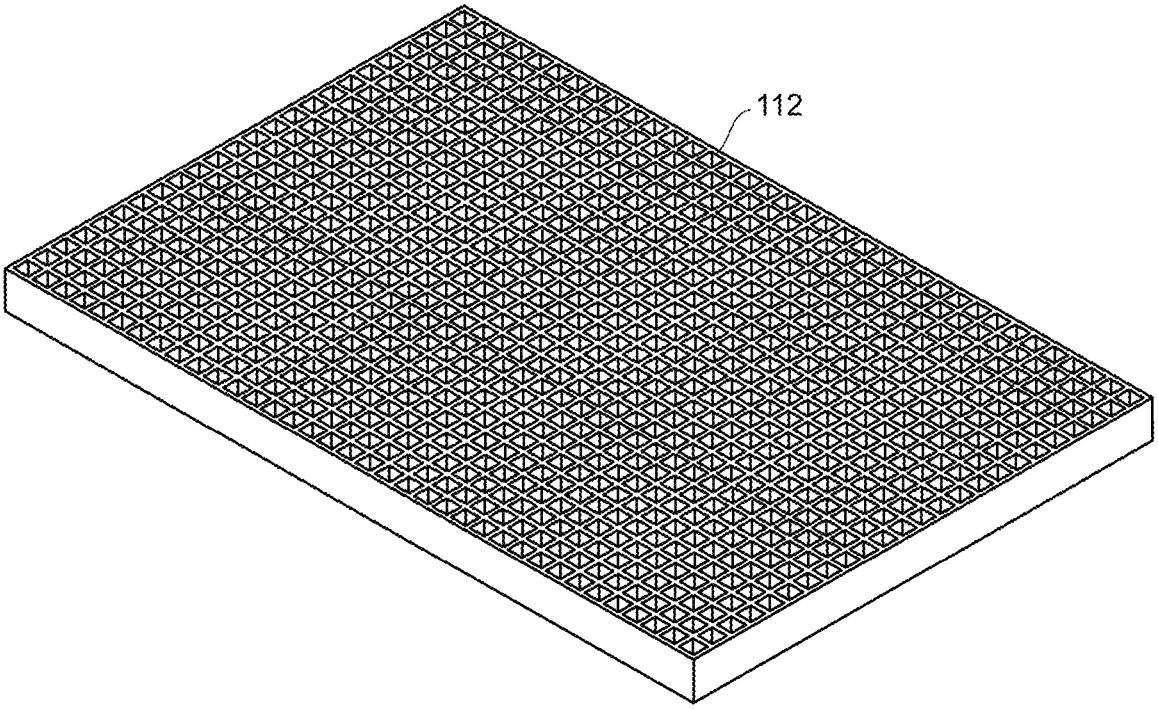
FIG. 36 is a perspective view of a cushioned device according to one embodiment of the present disclosure.
Figure 37:
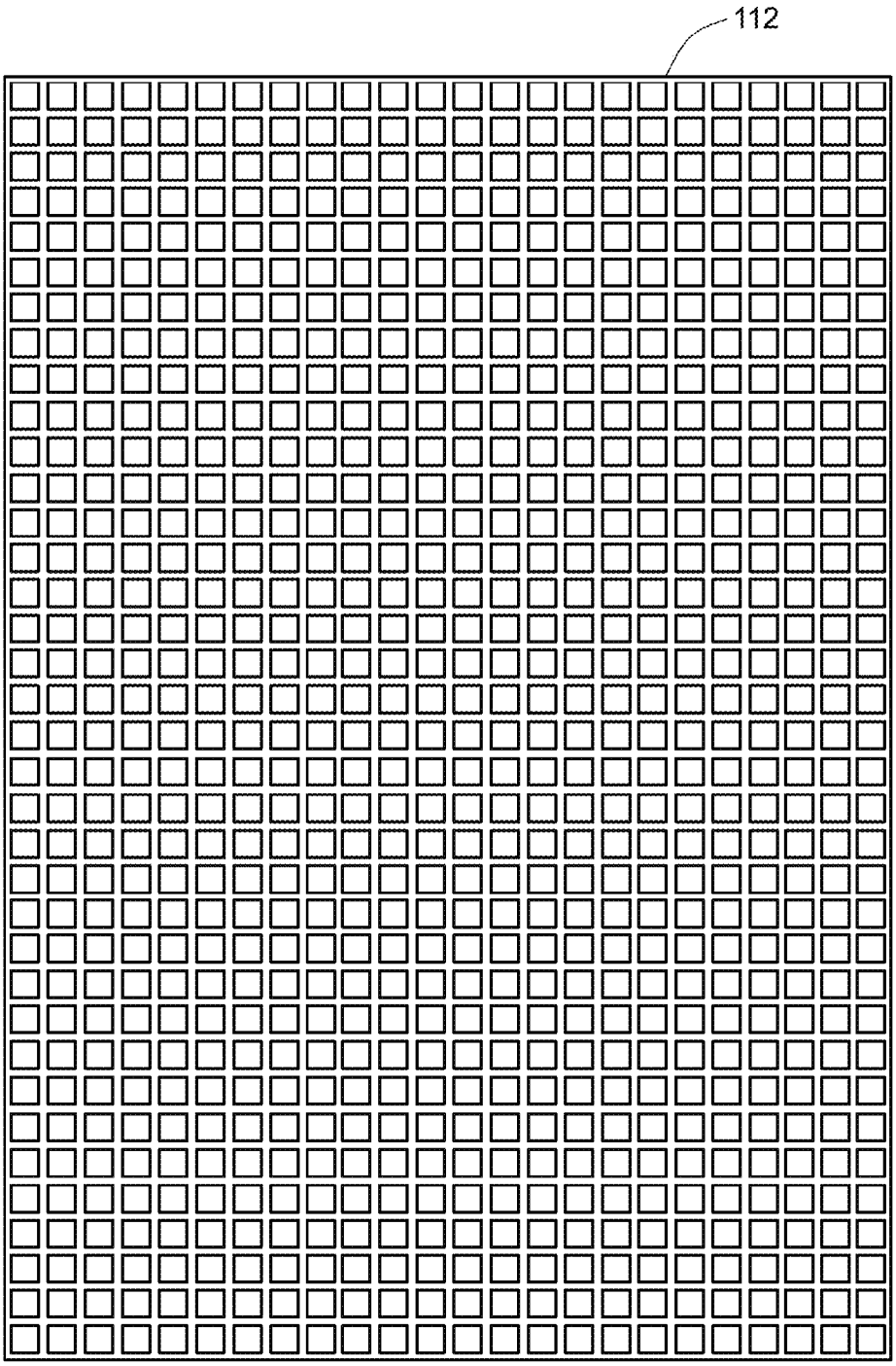
FIG. 37 is a top view of a cushioned device according to one embodiment of the present disclosure.

As shown in FIGS. 34A-c, the cushioned device 112 can be divided into a plurality of segments. In one embodiment, the plurality of segments can be coupled to one another using one or more magnets.

FIGS. 18A-D, 19A-C, 35A-37 show an exemplary embodiments of the cushioned device 112 that shows a precise number of apertures. In the shown embodiment, the number of apertures is 20 by 36. The apertures have a nominal grid dimension of one inch. It should be noted, however, that the number of apertures can vary. The range can be 18 to 20 and 12 to 36.

Figure 38:
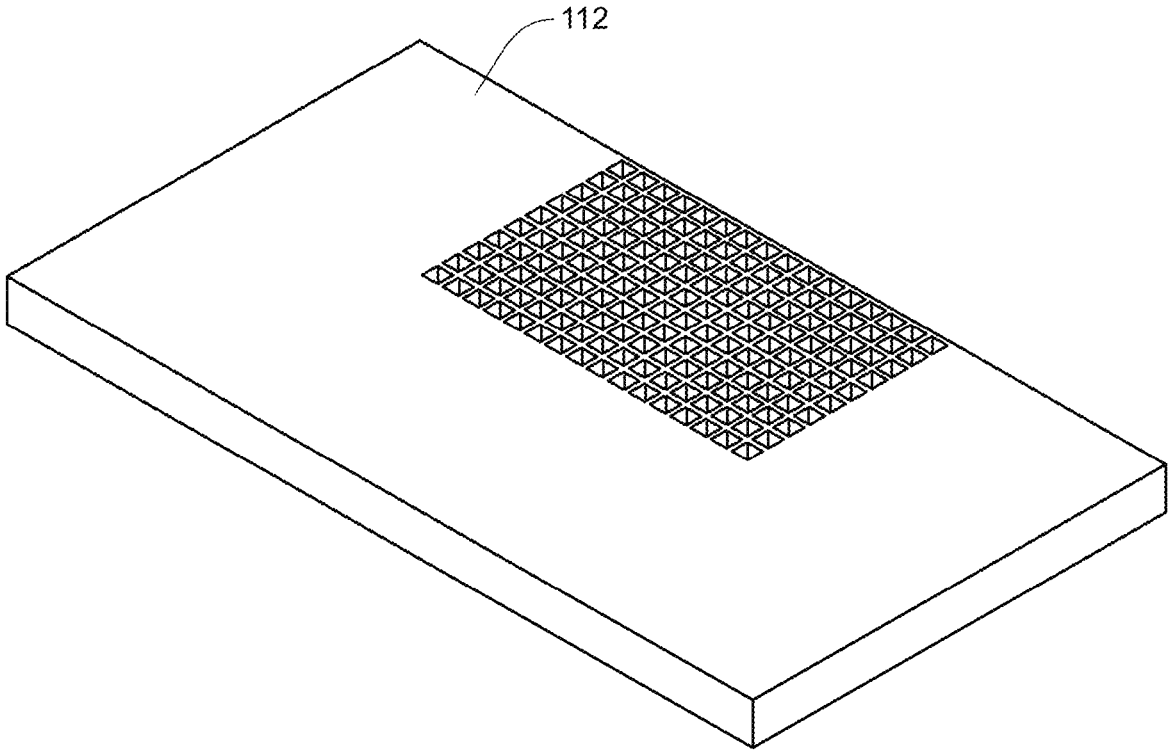
FIG. 38 is a perspective view of a cushioned device according to one exemplary embodiment of the present disclosure.
Figure 39A:
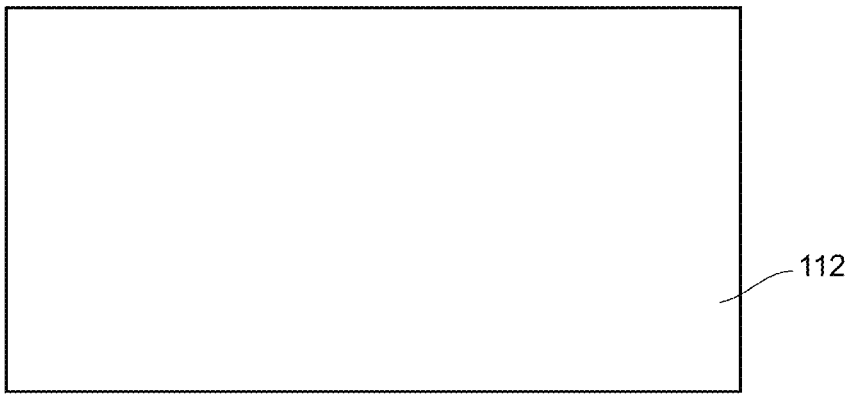
FIG. 39A is a top view of a cushioned device according to one exemplary embodiment of the present disclosure.
Figure 39B:
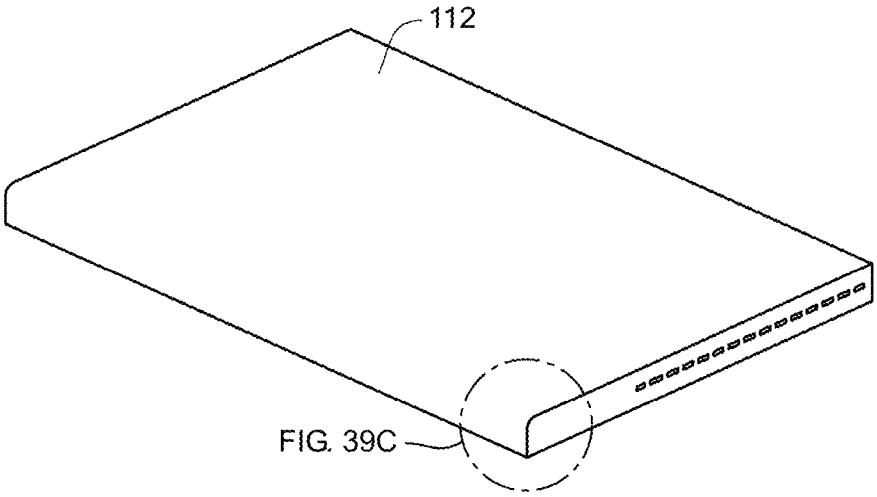
FIG. 39B is a perspective view of a cushioned device according to the exemplary embodiment of the present disclosure shown in FIG. 39A.
Figure 39C:
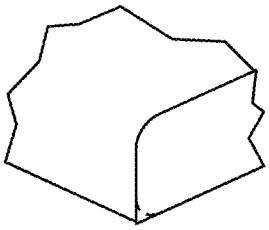
FIG. 39C is a close-up view of the cushioned device according to the exemplary embodiment of the present disclosure shown in FIG. 39A.
Figure 39D:
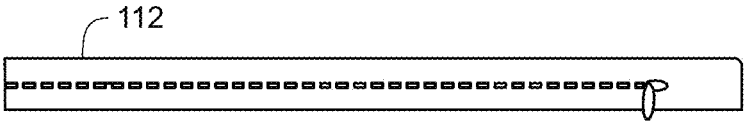
FIG. 39D is a side view of the cushioned device according to the exemplary embodiment shown in FIG. 39A.

FIG. 38 shows an exemplary embodiment of the cushioned device 112. The cushioned device 112 comprises a plurality of apertures, wherein the plurality of apertures are disposed closest to the back of the cushioned device 112. In one embodiment, the plurality of apertures form a rectangular shape. Those skilled in the art may recognize that the plurality of apertures may form other, similar shapes, without departing from the scope of the present disclosure.

FIGS. 24A-C and 39A-D depict an exemplary embodiment of the cushioned device 112. The cushioned device 112 comprises a cushion and a cover. The cover fully encloses the cushion. As shown in the figures, the front of the cushioned device 112 is curved so as to allow for greater comfort of the user. The cushioned device 112 includes a zipping mechanism on the side of the cushioned device 112 in order to allow for the cover to be separated from the cushion. Once the cover is separate, then the user can wash the cover or replace the cover with a new cover.

Figure 40:
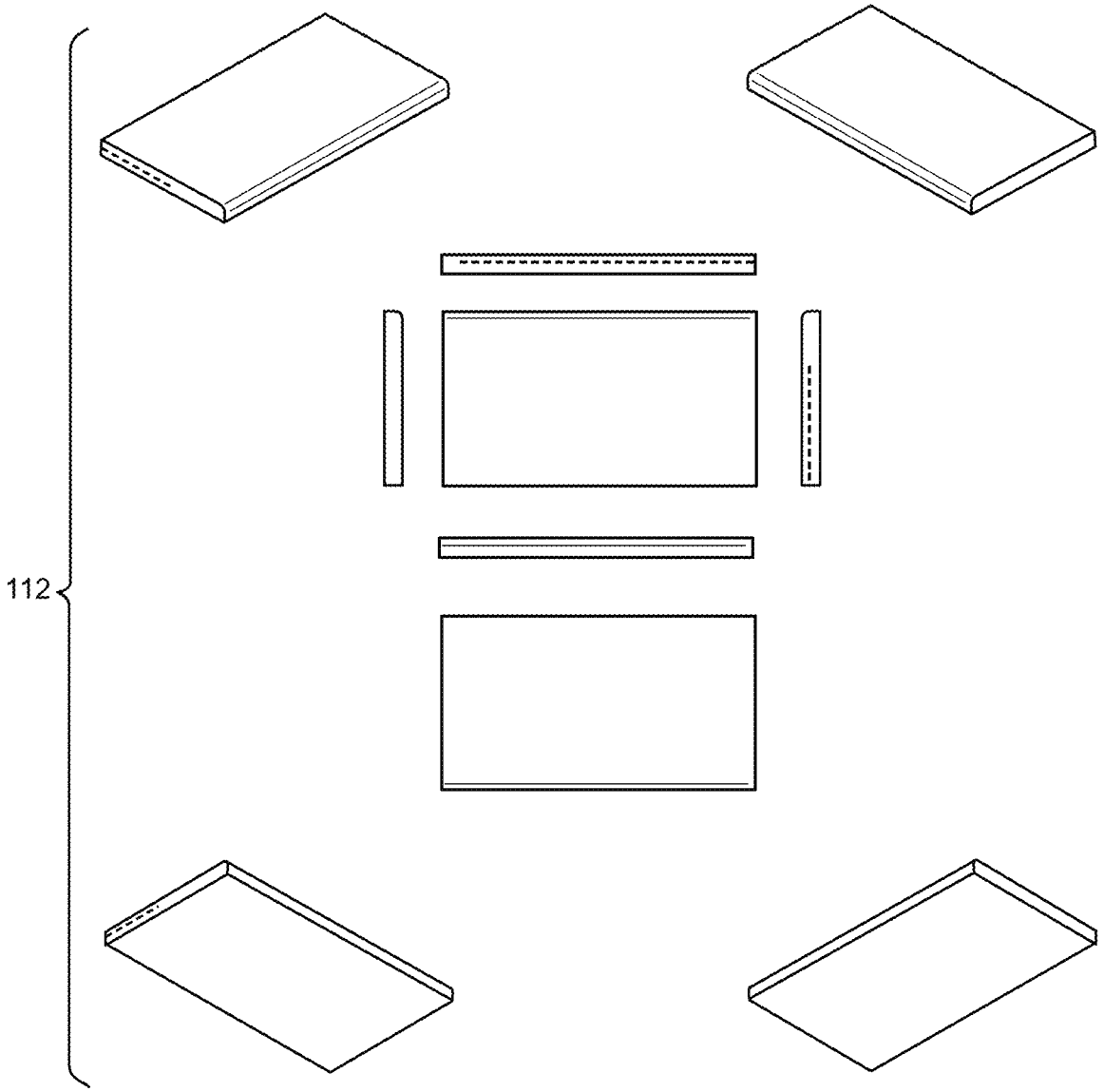
FIG. 40 is an exploded view of a cushioned device having a straight zipping mechanism according to one exemplary embodiment of the present disclosure.

FIG. 40 shows an exploded view of an exemplary embodiment of the cushioned device 112, wherein the cushioned device 112 includes a straight zipping mechanism.

Figure 41:
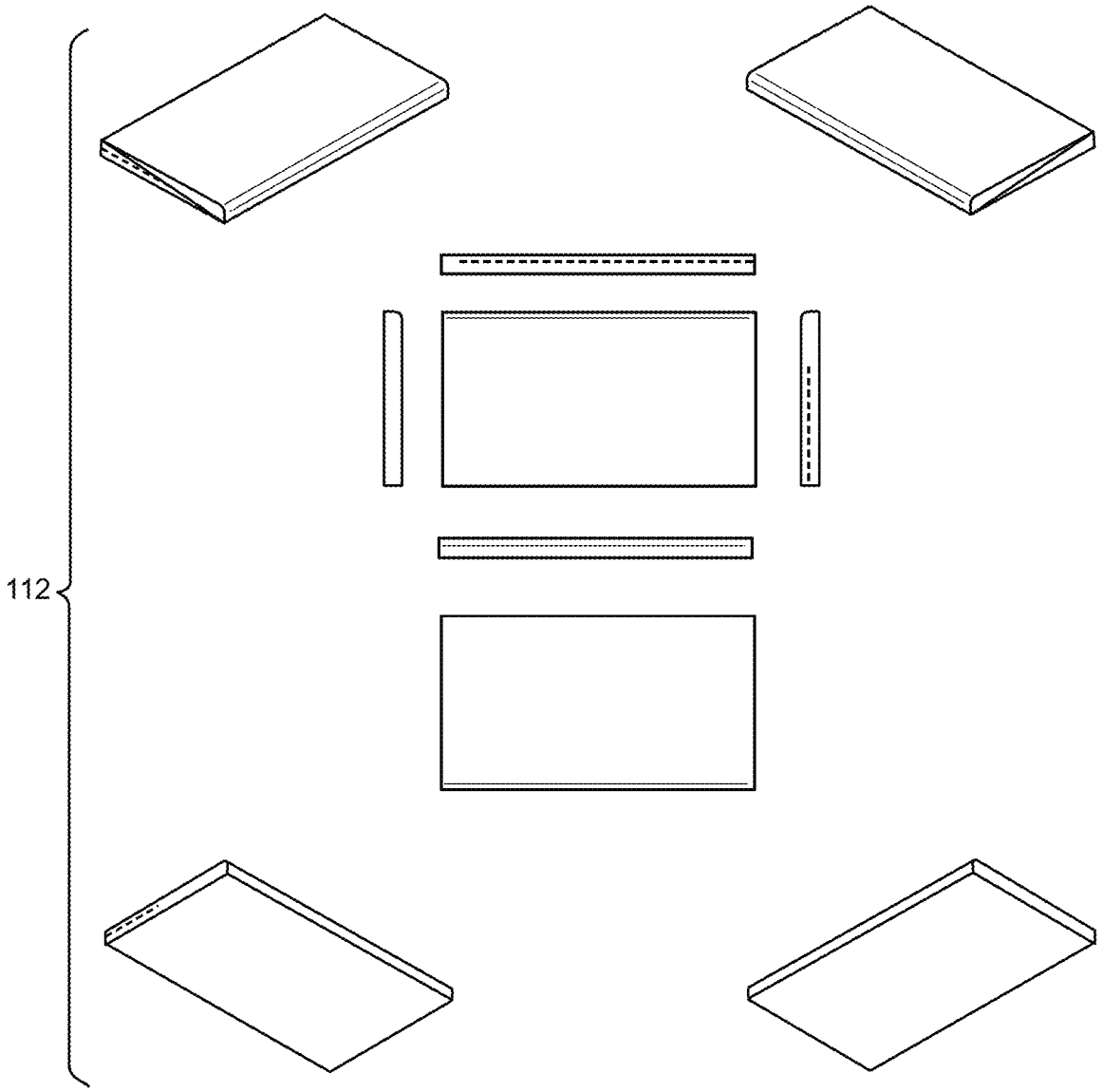
FIG. 41 is an exploded view of a cushioned device having a curved zipping mechanism according to one exemplary embodiment of the present disclosure.

FIG. 41 shows an exploded view of an exemplary embodiment of the cushioned device 112, wherein the cushioned device 112 includes a curved zipping mechanism.

Figure 42:
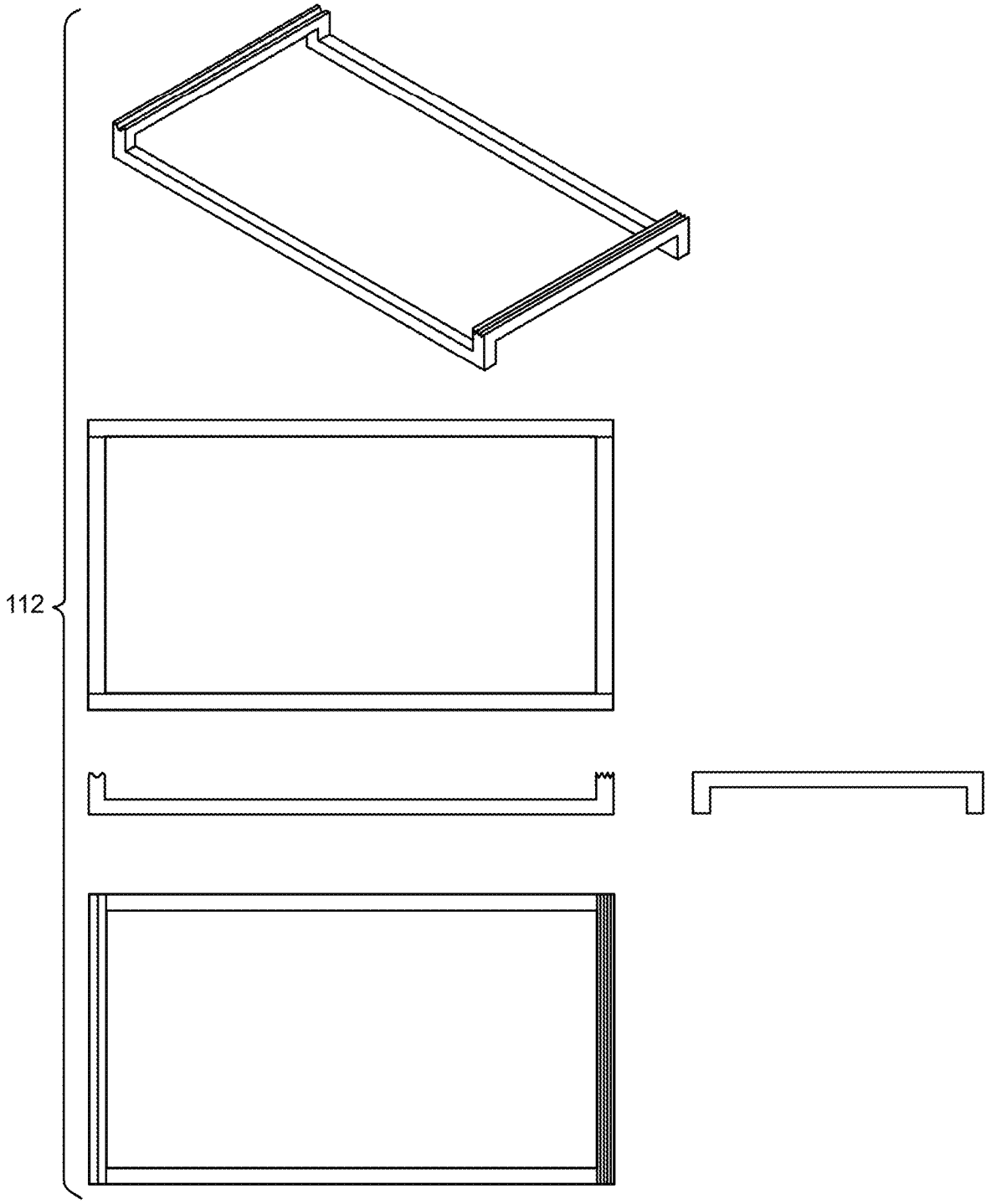
FIG. 42 is an exploded view of a cushioned device according to one exemplary embodiment of the present disclosure.

FIG. 42 shows an exploded view of an exemplary embodiment of the cushioned device 112. The cushioned device 112 comprises a plurality of rods or cords. The plurality of rods or cords may be pressed and fitted. In one exemplary embodiment, rod and cord material may be utilized in order to provide a suitable seal.

Although the present disclosure has been described with reference to preferred embodiments, workers skilled in the art will recognize that changes may be made in form and detail without departing from the spirit and scope of the invention. The foregoing is illustrative of the present disclosure and its inventive concepts and should not be construed as limiting thereof. Even though a few exemplary embodiments have been described, those skilled in the art will readily appreciate that many modifications are possible of the exemplary embodiments without materially departing from the novel teachings and advantages of the present disclosure and its inventive concepts. Accordingly, all such modifications are intended to be included within the scope of the present inventive concepts as defined in the claims. Therefore, it should be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

The invention claimed is:

1. A surface top assembly to reduce the impact and pressure on a user when resting body parts on a surface top, the surface top assembly comprising;

a cushion body, the cushioned body including a rod to provide stiffness and allow for rolling the surface top assembly;

a cushion body access mechanism to provide egress to an interior space defined by the cushion body, a filler inserted into the cushion body through the cushion body egress mechanism, and a support body that is disposed between the cushion body and the surface top.

2. The surface top assembly of claim 1 wherein the filler is comprised of a mesh upper and lower surface with a filament structure disposed therebetween.

3. The surface top assembly of claim 1 wherein the structure assembly is a segmented tube structure that matches the external planar dimension of the cushion body.

* * * * *